US009391419B2

(12) United States Patent
Yamaki et al.

(10) Patent No.: US 9,391,419 B2
(45) Date of Patent: Jul. 12, 2016

(54) METHOD FOR MANUFACTURING CONTACT TERMINAL, CONTACT TERMINAL MANUFACTURING APPARATUS, AND CONTACT TERMINAL

(71) Applicants: ASMO CO., LTD., Shizuoka-ken (JP); GIFU HIGHTECH CO., LTD., Gifu-ken (JP)

(72) Inventors: Takao Yamaki, Toyohashi (JP); Seiichi Murakami, Hamamatsu (JP); Takeshi Hamanaka, Gifu-ken (JP)

(73) Assignees: Asmo Co., Ltd., Shizuoka-Ken (JP); Gifu Hightech Co., Ltd., Gifu-Ken (JP)

( * ) Notice: Subject to any disclaimer, the term of this patent is extended or adjusted under 35 U.S.C. 154(b) by 736 days.

(21) Appl. No.: 13/718,635

(22) Filed: Dec. 18, 2012

(65) Prior Publication Data

US 2013/0157525 A1 Jun. 20, 2013

(30) Foreign Application Priority Data

Dec. 20, 2011 (JP) ..... 2011-278735

(51) Int. Cl.

| | |
|---|---|
| ***H01R 43/16*** | (2006.01) |
| ***B21D 22/20*** | (2006.01) |
| ***H01R 13/02*** | (2006.01) |
| ***B21D 37/08*** | (2006.01) |

(52) U.S. Cl.

CPC ..... *H01R 43/16* (2013.01); *B21D 22/20* (2013.01); *B21D 37/08* (2013.01); *H01R 13/02* (2013.01); *Y10T 29/49218* (2015.01)

(58) Field of Classification Search

CPC ..... H01R 13/02; B21D 22/04; B21D 22/206; B21D 22/28; B21D 22/283; B21D 22/06; B21D 24/005; B21D 37/08; B21D 22/26; B21D 22/30; B21D 53/36; Y10T 29/49218

USPC ..... 72/349, 256, 258, 361, 377, 404, 356, 72/358

See application file for complete search history.

(56) References Cited

U.S. PATENT DOCUMENTS 469,785 A * 3/1892 Hart ..... B21D 22/26 69/8
4,018,177 A * 4/1977 McKee ..... B21D 53/36 29/874

(Continued)

FOREIGN PATENT DOCUMENTS

CN 1610220 A 4/2005
CN 100999210 A 7/2007

(Continued)

OTHER PUBLICATIONS

Chinese Office Action of CN 201210593975.0 dated Nov. 27, 2015 with its English Translation.

*Primary Examiner* — Shelley Self
*Assistant Examiner* — Gregory Swiatocha
(74) *Attorney, Agent, or Firm* — Christensen Fonder P.A.

(57) ABSTRACT

A method for manufacturing a contact terminal including a contact portion that slides against a surface of a conductive contact plate. The manufacturing method includes forming a projection in a metal plate by performing a drawing process, wherein the projection projects in a thicknesswise direction of the metal plate and has a larger diameter than the contact portion. The manufacturing method further includes forming the contact portion from the projection by performing a contraction pressing process at least once on the projection so that the diameter of the projection gradually decreases, while the height of the projection remains the same or decreases in a stepwise manner.

7 Claims, 12 Drawing Sheets

(56) References Cited

U.S. PATENT DOCUMENTS

| | | | | |
|---|---|---|---|---|
| 5,908,664 | A * | 6/1999 | Nagayama | C10M 171/00 427/358 |
| 6,366,044 | B2 * | 4/2002 | Okai | B60S 1/08 15/250.13 |
| 2002/0003411 | A1 * | 1/2002 | Okai | B60S 1/08 318/445 |
| 2004/0046465 | A1 | 3/2004 | Murakami et al. | |

FOREIGN PATENT DOCUMENTS

| | | | |
|---|---|---|---|
| JP | S52-102872 | | 8/1977 |
| JP | 55-56753 | | 4/1980 |
| JP | S57-30221 | | 2/1982 |
| JP | H01-89815 | | 6/1989 |
| JP | 08094769 | A * | 4/1996 |
| JP | H08-94769 | A | 4/1996 |
| JP | H11-10254 | A | 1/1999 |
| JP | 2002-079912 | A | 3/2002 |
| JP | 2002-081905 | | 3/2002 |
| JP | 2004-104884 | | 4/2004 |
| JP | 2004-104885 | | 4/2004 |
| JP | 2004-104886 | | 4/2004 |
| JP | 2005-201384 | A | 7/2005 |
| JP | 2005201384 | A * | 7/2005 |

* cited by examiner

METHOD FOR MANUFACTURING CONTACT TERMINAL, CONTACT TERMINAL MANUFACTURING APPARATUS, AND CONTACT TERMINAL

BACKGROUND OF THE INVENTION

The present invention relates to a method for manufacturing a contact terminal that slides against a contact plate, an apparatus for manufacturing a contact terminal, and a contact terminal.

A motor used as a drive source for a vehicle wiper device includes a motor unit and a reduction gear unit, which are coupled integrally with each other. The motor unit rotates and drives a rotation shaft when supplied with power. The reduction gear unit reduces the speed of the rotation generated by the motor unit. The reduction gear unit accommodates a worm wheel, which forms a reduction gear mechanism, and an output shaft, which rotates integrally with the worm wheel. A link mechanism connects the output shaft to a wiper.

In such a motor, when a wiper switch is deactivated to stop the wiping action of the wiper, the wiper continues to move until reaching a predetermined stop position before stopping. To supply power to the motor unit in accordance with the position of the wiper, that is, the rotational position of the output shaft, the motor includes a rotation plate, which is used to detect the rotational position of the output shaft, and a plurality of contact terminals, which slide against the rotation plate (refer to, for example, Japanese Laid-Open Utility Model Publication No. 55-56753). A conductive plate undergoes a punching process to obtain a contact plate having a predetermined conductive pattern. The contact plate is then fixed to a holding member made of an insulating material. This forms the rotation plate, which is disk-shaped. The contact terminals are conductive and strip-shaped. Each contact terminal includes a distal part that defines a contact portion projecting in a thicknesswise direction of the contact terminal. Further, each contact terminal includes a basal part fixed to the interior of the motor. The contact portion of each contact terminal is in contact with and slidable against the surface of the rotation plate, which includes the surface of the holding member and the surface of the contact plate. In the motor, the detection of the rotational position of the output shaft and switching are performed based on the contact position of each contact terminal relative to the rotation plate.

As described in Japanese Laid-Open Patent Publication No. 2002-81905 (FIGS. 3 and 12), a pressing (drawing) process may be performed to form the contact portion of each contact terminal. Alternatively, a pin-shaped contact member, which is a discrete member, may be inserted through and fixed to a distal part of a strip-shaped metal plate, which forms a contact terminal, to use the contact member as a contact portion.

The contact portion of each contact terminal slides against the surface of the rotation plate when the rotation plate rotates and passes by the boundary between the contact plate and the holding member from the surface of the contact plate to the surface of the holding member. In this case, an increase in the contact area between the contact portion and the surface of the rotation plate increases the time required from when the contact portion reaches the boundary to when the contact portion completely passes by the boundary. This decreases the detection accuracy of the rotational position of the output shaft and the switching position accuracy. To increase the accuracy, it is desirable that the state of conduction between the contact portion and the rotation plate be quickly switched. To quickly switch the state of conduction, it is desirable that the distal part of the contact portion be thinly formed.

Further, at the boundary between the contact plate and the holding member, contact of the contact portion with a corner at an edge of the contact plate may cause abrasion when the state of conduction switches in addition to abrasion caused by sliding of the contact plate. Thus, in addition to having a thin distal part, it is desirable that the contact portion be formed to have sufficient height (length).

When a pressing process is performed to form the contact portions, the contact terminals including the contact portions can be formed from the same metal plate. This lowers the cost for forming the contact terminals. However, the contact terminals are small. Thus, when forming each contact terminal with a thin distal part and a contact portion having an increased height, cracks may form during the pressing process, especially, at the contact portion.

A contact terminal including a thin distal part and a contact portion having an increased height can be formed by fixing the discrete pin-shaped contact portion to the metal plate. However, this requires the contact member in addition to the metal plate. Further, in addition to performing a pressing process on the metal plate in accordance with the shape of the contact terminal, a process for fixing the contact member to the metal plate is performed. This increases manufacturing costs.

SUMMARY OF THE INVENTION

It is an object of the present invention to provide a method for manufacturing a contact terminal, an apparatus for manufacturing a contact terminal, and a contact terminal that prevents the formation of cracks at a contact portion even when a discrete contact member is not used, while ensuring that a contact portion is thin and has sufficient height in the same manner as when using a contact member.

One aspect of the present invention is a method for manufacturing a contact terminal including a contact portion that slides against a surface of a conductive contact plate. The manufacturing method includes forming a projection in a metal plate by performing a drawing process. The projection projects in a thicknesswise direction of the metal plate and has a larger diameter than the contact portion. The manufacturing method further includes forming the contact portion from the projection by performing a contraction pressing process at least once on the projection so that the diameter of the projection gradually decreases, while the height of the projection remains the same or decreases in a stepwise manner.

A further aspect of the present invention is an apparatus for manufacturing a contact terminal including a contact portion that slides against a surface of a conductive contact plate. The manufacturing apparatus is provided with a die plate including a plurality of die cavities arranged along a feeding direction of a metal plate that forms the contact terminal. The die cavities are arranged from one having a larger diameter than the contact portion to one having the same diameter as the contact portion so that the diameter gradually decreases, and the die cavities have the same depth or a depth that gradually decreases in the feeding direction. A plurality of punches can respectively be fitted into the die cavities to cooperate with the die cavities and perform a pressing process on the metal plate arranged between the punches and the die cavities. The one of the die cavities having the largest diameter is used to perform a drawing process that forms a projection in the metal plate. The projection projects in a thicknesswise direction of the metal plate. The contact portion is formed from the projection by performing a pressing process that gradually decreases the diameter of the projection with the remaining die cavities from those having larger diameters.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment according to the present invention will now be described with reference to the drawings.

Figure 1:
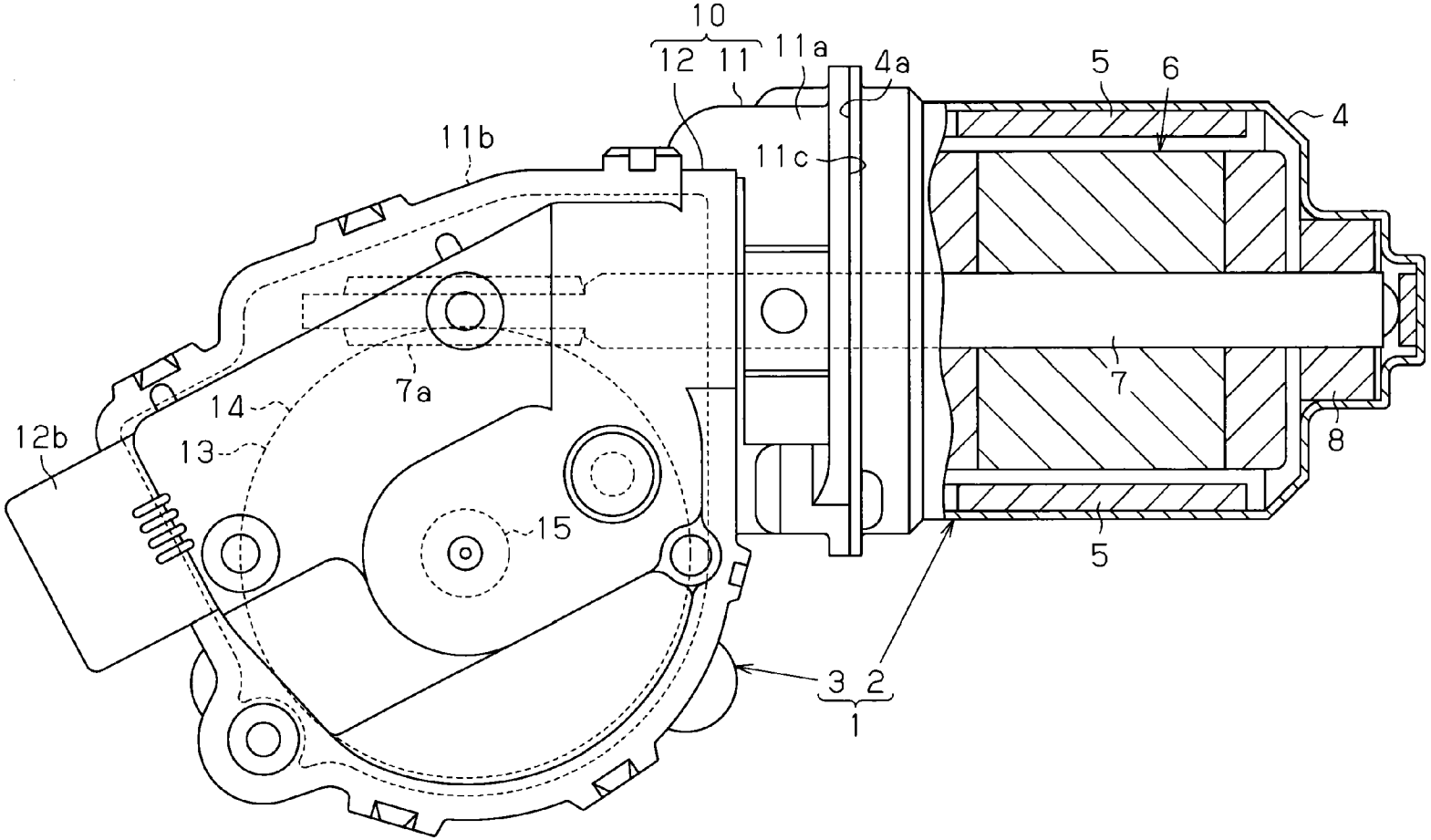
FIG. 1 is a plan view of a motor.

FIG. 1 shows a motor 1 of the present embodiment used as a drive source for a vehicle wiper device that wipes off water such as raindrops from a vehicle windshield of the vehicle. The motor 1 includes a motor unit 2, which generates rotation, and a reduction gear unit 3, which reduces the speed of the rotation generated by the motor unit 2 and outputs the rotation.

The motor unit 2 includes a cylindrical yoke housing 4, which has a closed end, and two pairs (four in total) of magnets 5, which are fixed to the inner circumferential surface of the yoke housing 4. The magnets 5 of each pair are opposed to each other in the radial direction of the yoke housing 4. A rotatable armature 6 is arranged at the inside of the two pairs of magnets 5. The armature 6 includes a rod-shaped rotation shaft 7 having a basal part supported by a bearing 8, which is arranged in the yoke housing 4 at the center of the closed end. The rotation shaft 7 has a distal part that projects out of the yoke housing 4 from an open end 4*a*. The distal portion of the rotation shaft 7 includes a threaded worm 7*a*. A gear housing 10, which forms part of the reduction gear unit 3, is coupled to the open end 4*a* of the yoke housing 4 to accommodate the distal part of the rotation shaft 7.

The reduction gear unit 3 accommodates the reduction gear mechanism 13, which reduces the speed of the rotation of the rotation shaft 7 in the gear housing 10. The gear housing 10 includes a first housing case 11 and a second housing case 12. The first housing case 11 is formed from a conductive metal such as aluminum alloy. The second housing case 12 is hollow, formed from an insulating resin material, and coupled to the first housing case 11.

Figure 7:
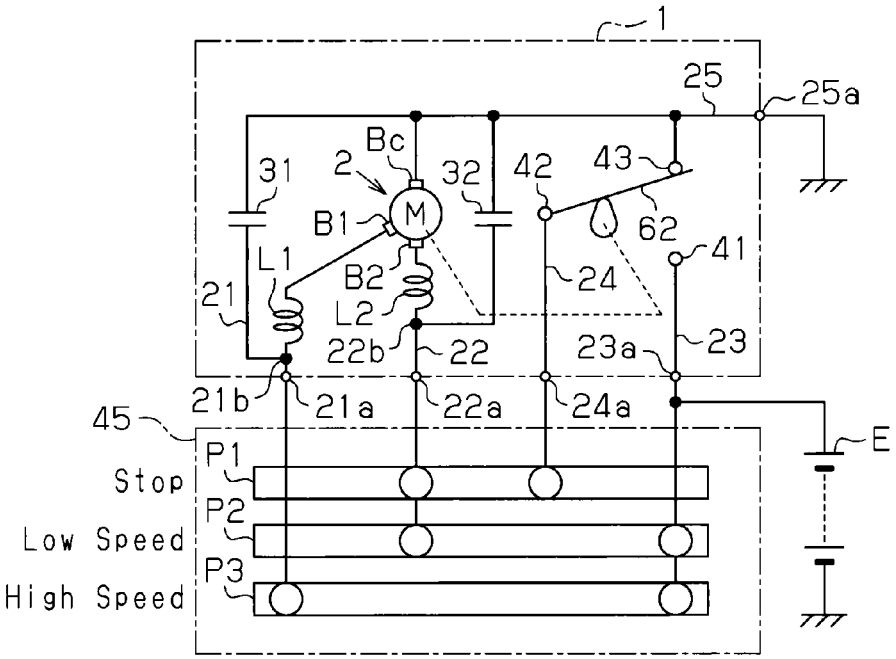
FIG. 7 is an electrical circuit diagram of a vehicle wiper device.

The first housing case 11 includes a cylindrical coupling portion 11*a*, which has a closed end and is fixed to the open end 4*a* of the yoke housing 4, and an accommodation portion 11*b*, which is dish-shaped and formed integrally with the closed end of the coupling portion 11*a*. The coupling portion 11*a* has an open end 11*c* having the same shape as the open end 4*a* of the yoke housing 4. The distal part of the rotation shaft 7 (i.e., part where the worm 7*a* is formed) inserted into the first housing case 11 from the open end 11*c* and arranged in the accommodation portion 11*b* extending through the closed end of the coupling portion 11*a*. A bearing (not illustrated), which supports the rotation shaft 7 together with the bearing 8, is arranged on the closed end of the coupling portion 11*a*. A brush device (not illustrated), which supplies power to the armature 6, is accommodated and fixed in the coupling portion 11*a*. The brush device forms the motor unit 2. As illustrated in FIG. 7, the brush device includes a high-speed power supplying brush B1 and low-speed power supplying brush B2, which supply power to the armature 6, and a common brush Bc, which is commonly used when supplying power to the armature 6 with the high-speed power supplying brush B1 and when supplying power to the armature 6 when supplying power to the low-speed power supplying brush B2.

Figure 2:
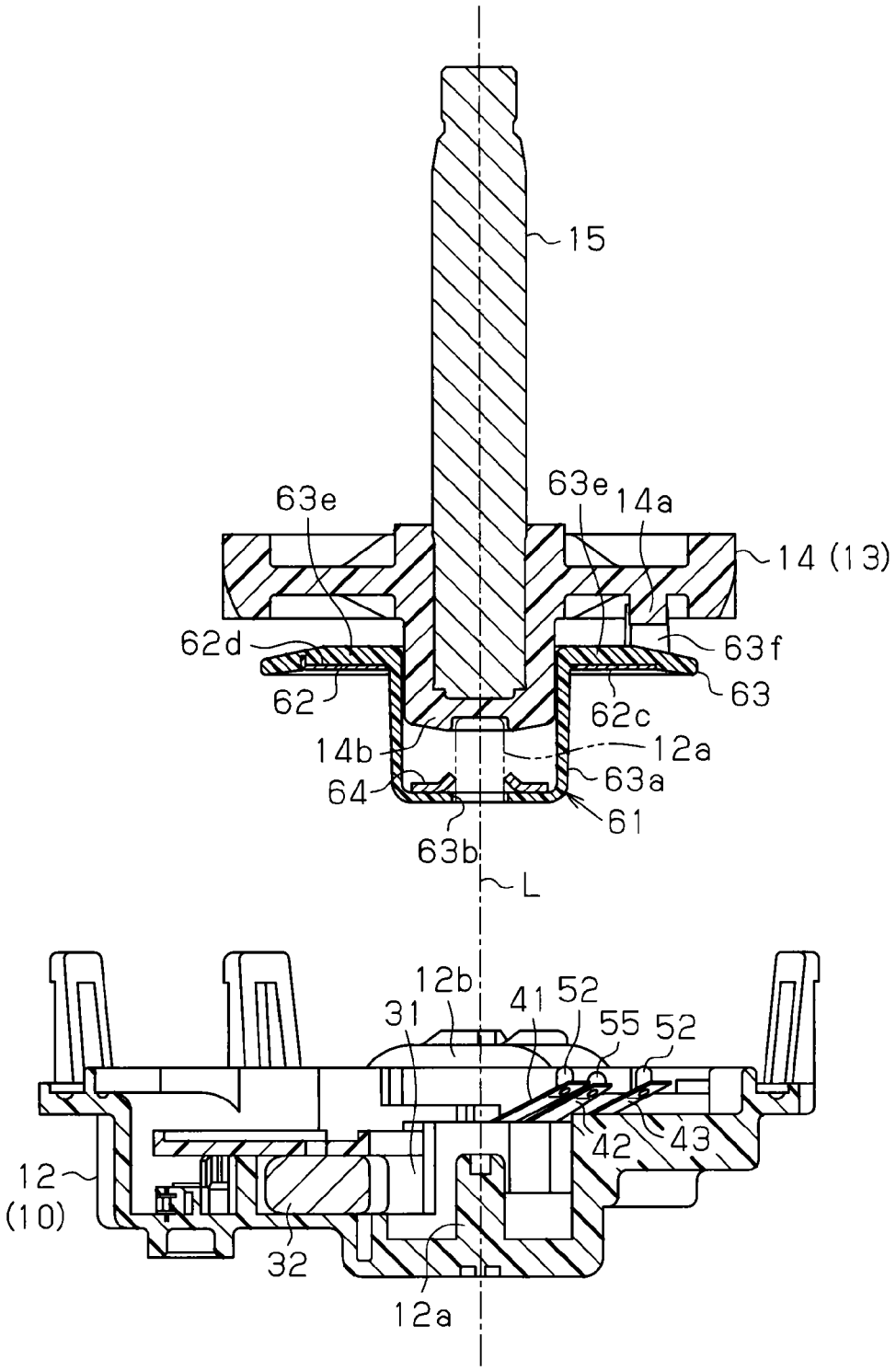
FIG. 2 is a cross-sectional view showing a second housing, a worm wheel, an output shaft, and a rotation plate, with the cross-sectional view of the second housing taken along line II-II in FIG. 4)
Figure 3:
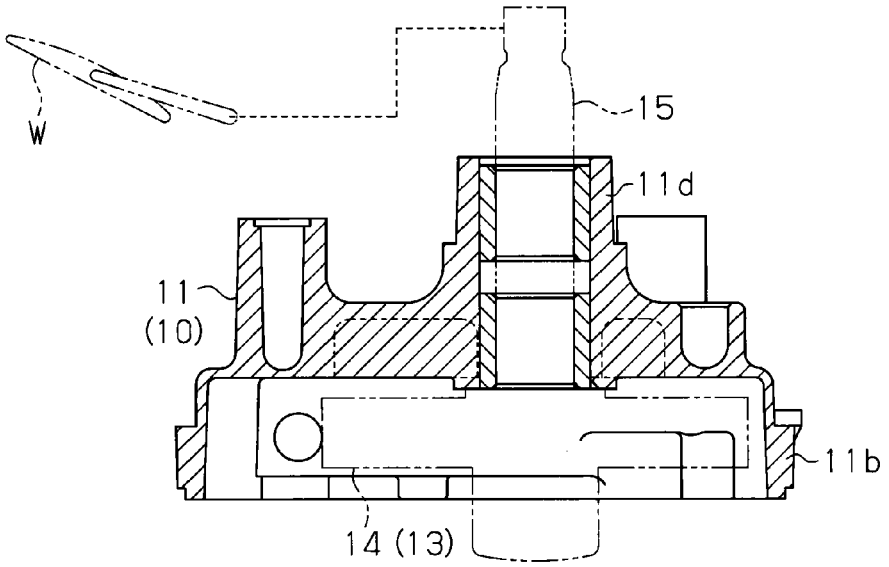
FIG. 3 is a cross-sectional view of a first housing.

As illustrated in FIG. 1, the accommodation portion 11*b* accommodates a worm wheel 14 that forms the reduction gear mechanism 13 with the worm 7*a*. The worm wheel 14 is disk-shaped and engaged with the worm 7*a*. As illustrated in FIG. 2, the axial end of the worm wheel 14 that is closer to the second housing case 12 includes a gear engagement protrusion 14*a* protruding in the axial direction of the worm wheel 14 toward a rotation plate 61, which will be described later. The gear engagement protrusion 14*a* is located outward in the radial direction of the worm wheel 14 from a central portion of the worm wheel 14. The central portion of the worm wheel 14 defines a cylindrical fixing portion 14*b* to receive a basal part of a cylindrical output shaft 15. The output shaft 15 is fixed to the fixing portion 14*b* so that relative rotation of the output shaft 15 and the worm wheel 14 is not possible. As illustrated in FIG. 3, the output shaft 15 includes a distal part extending through the accommodation portion 11*b* and projecting out of the gear housing 10. The output shaft 15 is supported by the accommodation portion 11*b*. Specifically, the bottom of the accommodation portion 11*b* includes a cylindrical support portion 11*d*, which projects outward from the gear housing 10 and supports the output shaft 15. The distal part of the output shaft 15 is connected by a link mechanism (not illustrated) of a vehicle wiper device to a wiper W.

Figure 4:
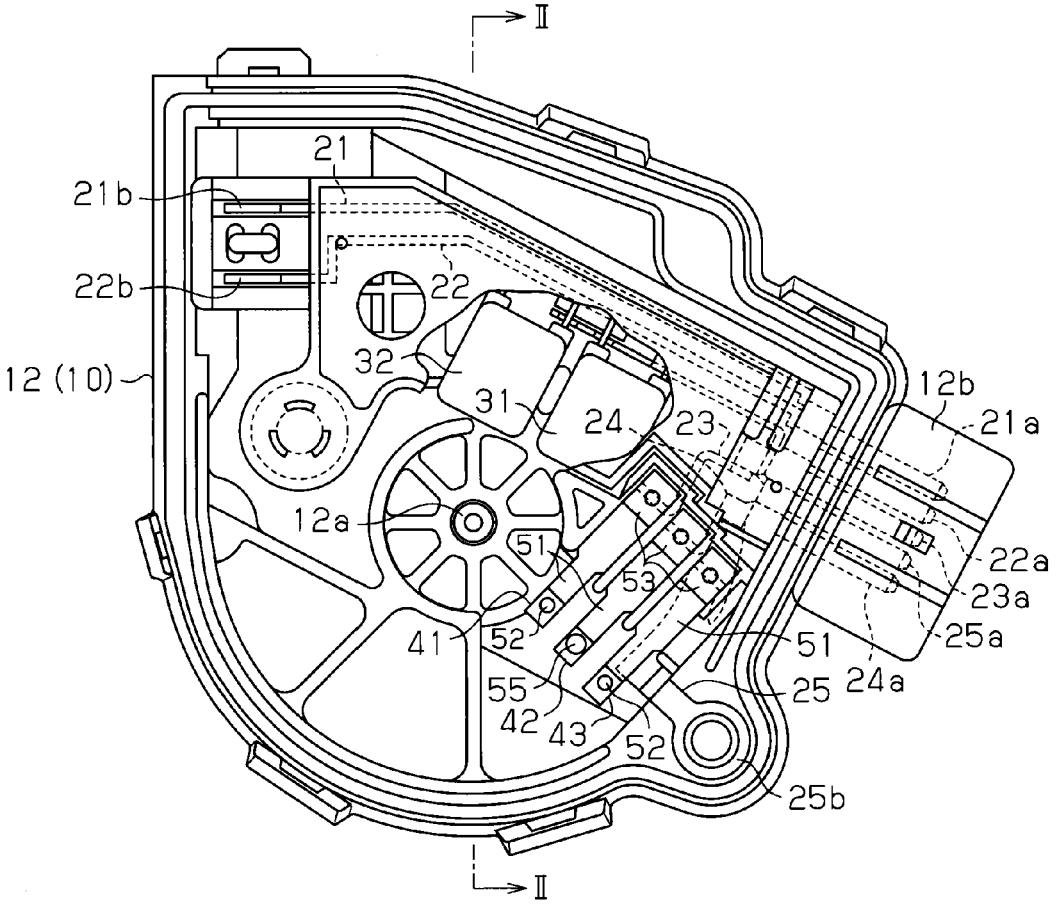
FIG. 4 is a plan view of the second housing.

As illustrated in FIG. 1, the second housing case 12 is dish-shaped in conformance with the open end of the accommodation portion 11*b* and fixed to the first housing case 11 to close the open end of the accommodation portion 11*b*. As illustrated in FIGS. 2 and 4, a central portion in the second housing case 12 includes a support pin 12*a* that projects into the gear housing 10 along the axial direction of the output shaft 15. The support pin 12*a* is cylindrical.

The second housing case 12 includes a cylindrical connector portion 12*b* that projects outward from the gear housing 10. The second housing case 12 includes a plurality of (five in the present embodiment) terminal members 21 to 25. Each of the terminal members 21 to 25 is punched out of a conductive metal plate into a predetermined shape and then bent at a number of locations. The terminal members 21 to 25 are insert-molded and partially buried in the second housing case 12.

As illustrated in FIGS. 4 and 7, among the five terminal members 21 to 25, the first terminal member 21, which is located at the uppermost position in FIG. 4, is strip-shaped and bent at a number of locations. One longitudinal end of the first terminal member 21 forms a first connection terminal 21*a* that projects into the connector portion 12*b* and is exposed to the exterior of the gear housing 10. The other longitudinal end of the first terminal member 21 forms a first motor connection terminal 21*b* that projects into the gear housing 10 from the inner surface of the second housing case 12. The first motor connection terminal 21*b* is connected to the high-speed power supplying brush B1 by a choke coil L1. The first terminal member 21 is connected to a first terminal of a first noise protection capacitor 31 arranged on the inner surface of the second housing case 12.

A second terminal member 22 is arranged closer to the center of the second housing case 12 than the first terminal member 21 and is adjacent to the first terminal member 21. The second terminal member 22 is strip-shaped and bent at a number of locations. One longitudinal end of the second terminal member 22 forms a second connection terminal 22*a* that projects into the connector portion 12*b* and is exposed to the exterior of the gear housing 10. The other longitudinal end of the second terminal member 22 forms a second motor connection terminal 22*b* that projects into the gear housing 10 from the inner surface of the second housing case 12. The second motor connection terminal 22*b* is connected to the low-speed power supplying brush B2 by a choke coil L2. The second terminal member 22 is connected to a first terminal of a second noise protection capacitor 32 arranged on the inner surface of the second housing case 12.

The third terminal member 23, which is located in the vicinity of the connector portion 12*b* in the second housing case 12, includes a third connection terminal 23*a* that projects into the connector portion 12*b* and is exposed to the exterior of the gear housing 10 is formed. The opposite end of the third terminal member 23 is connected to a first fixed contact terminal 41, which serves as a contact terminal and is fixed to the inner surface of the second housing case 12. The fourth terminal member 24, which is located in the vicinity of the third terminal member 23 in the second housing case 12, includes a fourth connection terminal 24*a* that projects into the connector portion 12*b* and is exposed to the exterior of the gear housing 10. The opposite end of the fourth terminal member 24 is connected to a second fixed contact terminal 42, which is fixed to the inner surface of the second housing case 12.

The fifth terminal member 25, which is located in the vicinity of the connector portion 12*b* in the second housing case 12, includes a fifth connection terminal 25*a* that projects into the connector portion 12*b* and is exposed to the exterior of the gear housing 10. The fifth terminal member 25 is connected to a third fixed contact terminal 43, which serves as a contact terminal and is fixed to the inner surface of the second housing case 12. The fifth terminal member 25 includes a ground terminal 25*b* held between a peripheral portion of the first housing case 11 and a peripheral portion of the second housing case 12. The ground terminal 25*b* is fastened by a screw (not illustrated) that fastens together the first housing case 11 and the second housing case 12. The fifth terminal member 25 is connected to a second terminal of the first noise protection capacitor 31 and a second terminal of the second noise protection capacitor 32.

An external connector (not illustrated) is connected to the connector portion 12*b*. The external connector and the first to fifth terminal members 21 to 25 supply power to the motor unit 2. Specifically, the first to fourth connection terminals 21*a* to 24*a* are connected by the external connector to a wiper switch 45, which is arranged near the driver's seat in the vehicle. The third connection terminal 23*a* is connected to a positive terminal of a battery power supply E of the vehicle, and the fifth connection terminal 25*a* is connected to ground.

Figure 5A:
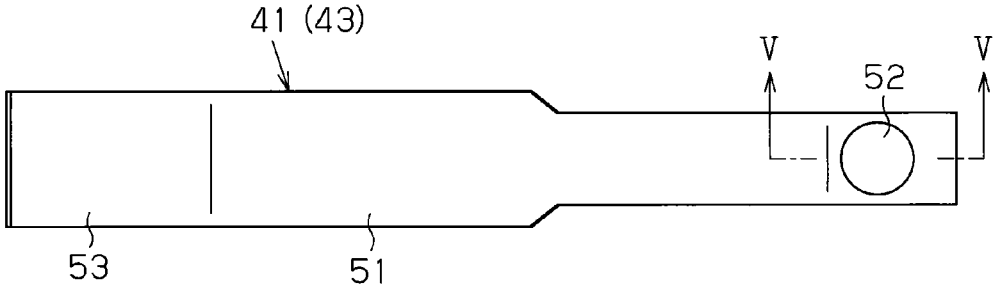
FIG. 5A is a plan view of first and third fixed contact terminals.
Figure 5B:
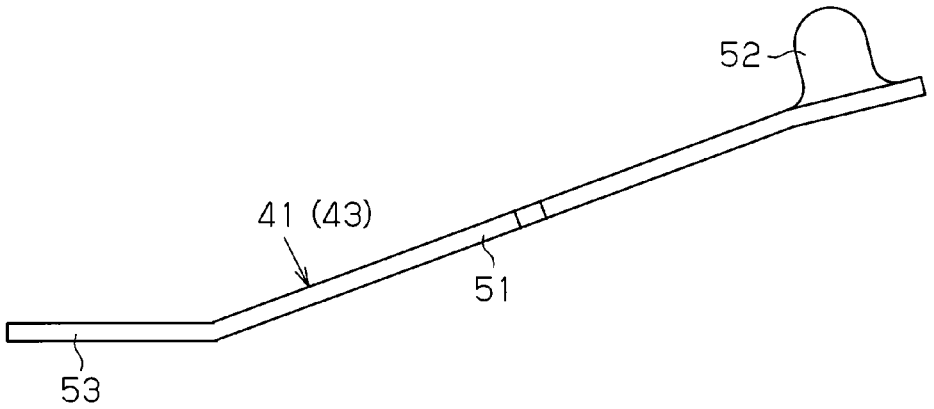
FIG. 5B is a side view of the first and third fixed contact terminals.

Referring to FIGS. 5A and 5B, the first fixed contact terminal 41 is formed by a conductive metal plate (for example, a phosphor bronze plate). The first fixed contact terminal 41 includes a planar portion 51, which is strip-shaped, and a contact portion 52, which is formed by performing a pressing process (including a drawing process) on the distal part of the planar portion 51. The planar portion 51 has a thickness of, for example, 0.4 mm. The distal part (right side as viewed in the drawing) of the planar portion 51 is slightly reduced in width as compared with the basal part (left side as viewed in the drawing) of the planar portion 51. The planar portion 51 is bent in the thicknesswise direction near its basal end. The section from the bent portion of the planar portion 51 to the basal end defines a fixed end 53, which serves as a basal part that is tetragonal, planar, and fixes the first fixed contact terminal 41 to the second housing case 12. In the planar portion 51, the section extending from the bent portion toward the distal end, which is opposite the basal end, along the longitudinal direction of the planar portion 51 serves as an extension. A section further extending from the extension to the distal end serves as a distal part.

Figure 5C:
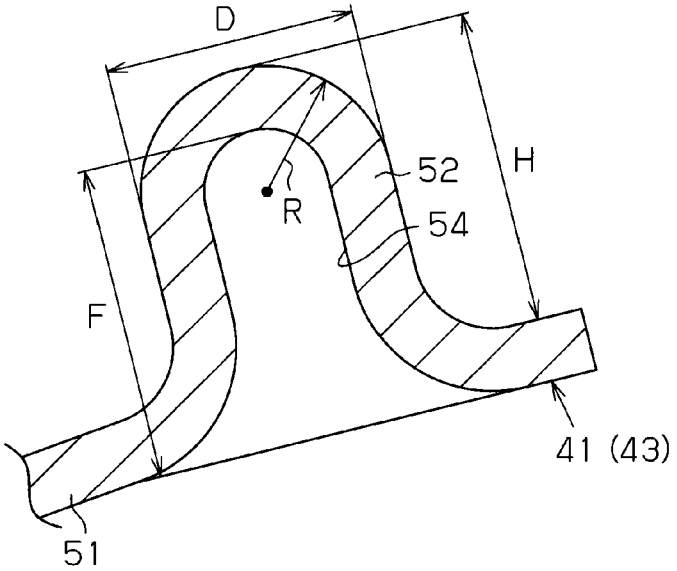
FIG. 5C is a cross-sectional view taken along line V-V in FIG. 5A illustrating the vicinity of a contact portion in the first and third fixed contact terminals.

As illustrated in FIGS. 5A and 5C, the contact portion 52 is formed in the distal part of the planar portion 51 at a central section in the widthwise direction of the planar portion 51. A pressing process is performed to form the contact portion 52, which projects in the thicknesswise direction. This obtains a contact recess 54, which opens in the direction opposite to the projecting direction of the contact portion 52, in the contact portion 52. The contact portion 52 is cylindrical and has a semispherical distal part. The contact portion 52 has a height H of, for example, 2.4 mm, a diameter D of, for example, 1.6 mm, and a thickness of, for example, 0.4 mm. In the cross-sectional view of FIG. 5C, the diameter D is the outer diameter of the contact portion 52 excluding the basal part of the contact portion 52 where the diameter gradually increases.

As illustrated in FIG. 4, the first fixed contact terminal 41 is fixed to the second housing case 12 so that the fixed end 53 is fixed to the inner surface of the second housing case 12 in a state in which the distal end of the contact portion 52 faces the side opposite to the second housing case 12 (i.e., the side of the worm wheel 14). The first fixed contact terminal 41 is electrically connected to the third terminal member 23 at the fixed end 53. When a pressing force is applied in the thicknesswise direction to the distal part of the first fixed contact terminal 41, the planar portion 51 is elastically deformed. This moves the distal part of the first fixed contact terminal 41 in the thicknesswise direction relative to the fixed end 53.

The second fixed contact terminal 42 includes a planar portion 51, which is similar to that of the first fixed contact terminal 41, and a contact portion 55, which is formed by performing a pressing process on the distal part of the planar portion 51. The contact portion 55 is formed in the distal part of the planar portion 51 at a central section in the widthwise direction of the planar portion 51 and projects in the thicknesswise direction of the planar portion 51. The contact portion 55 has a semispherical shape. The contact portion 55 has a smaller height than the contact portion 52 of the first fixed contact terminal 41 and a larger diameter than the contact portion 52 of the first fixed contact terminal 41.

The second fixed contact terminal 42 is fixed to the second housing case 12 by fixing the fixed end 53 to the inner surface of the second housing case 12 in a state in which the distal end of the contact portion 55 faces the side opposite to the second housing case 12 (i.e., the side of the worm wheel 14). The second fixed contact terminal 42 is electrically connected to the fourth terminal member 24 at the fixed end 53. The second fixed contact terminal 42 is arranged in parallel to the first fixed contact terminal 41. When a pressing force is applied in the thicknesswise direction to the distal part of the second fixed contact terminal 42, the planar portion 51 is elastically deformed. This moves the distal part of the second fixed contact terminal 42 in the thicknesswise direction relative to the fixed end 53.

The third fixed contact terminal 43 has the same shape as the first fixed contact terminal 41. The third fixed contact terminal 43 is fixed to the second housing case 12 by fixing the fixed end 53 to the inner surface of the second housing case 12 in a state in which the distal end of the contact portion 52 faces the side opposite to the second housing case 12 (i.e., the side of the worm wheel 14. The third fixed contact terminal 43 is electrically connected to the fifth terminal member 25 at the fixed end 53. The third fixed contact terminal 43 is arranged in parallel to the first fixed contact terminal 41 and the second fixed contact terminal 42. When a pressing force is applied in the thicknesswise direction to the distal part of the third fixed contact terminal 43, the planar portion 51 is elastically deformed. This moves the distal part of the third fixed contact terminal 43 in the thicknesswise direction relative to the fixed end 53. As illustrated in FIGS. 2 and 4, the contact portions 52 and 55 at the distal parts of the first to third fixed contact terminals 41 to 43 are located at positions overlapped with the worm wheel 14 in the axial direction and are arranged along a single line extending in the radial direction of the worm wheel 14.

As illustrated in FIG. 2, the rotation plate 61, which is rotated by the worm wheel 14, is accommodated in the gear housing 10. The rotation plate 61 includes a movable contact plate 62, which serves as a contact plate, and a holding member 63, which is formed integrally with the movable contact plate 62.

Figure 6:
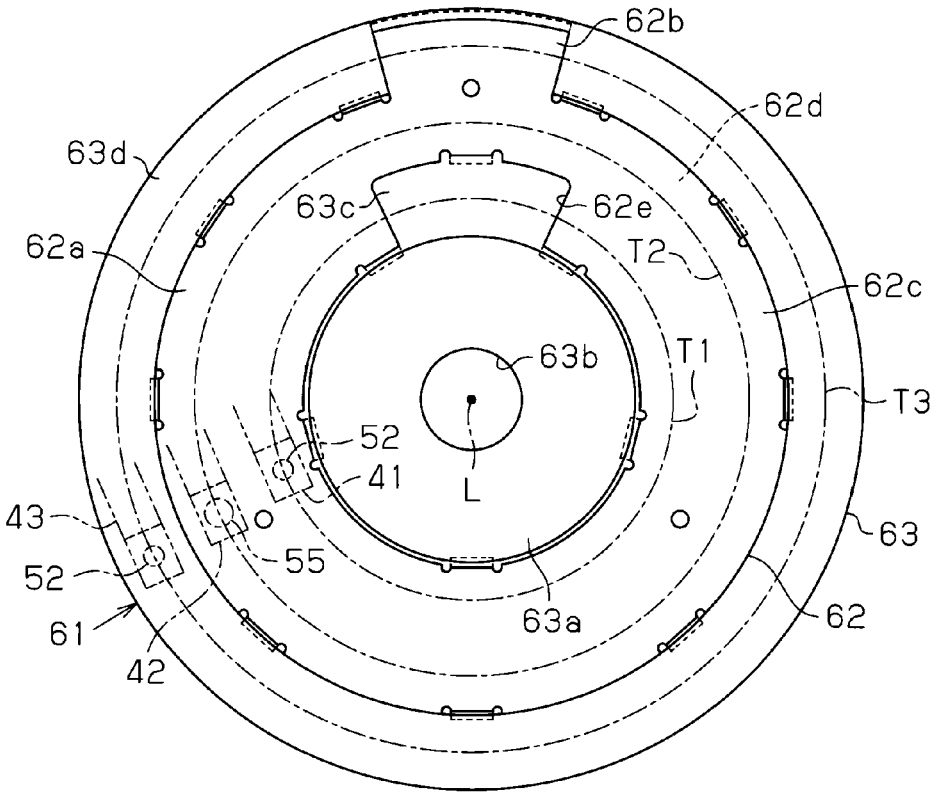
FIG. 6 is a front view of the rotation plate.

Referring to FIG. 6, the movable contact plate 62 is formed by performing a pressing process, which punches out a workpiece having a predetermined shape from a conductive metal plate, and then bending the workpiece at a number of locations. The movable contact plate 62 includes a first conductive portion 62*a*, which has an annular and planar shape, and a second conductive portion 62*b*, which is tab-like and extends outward in the radial direction from the first conductive portion 62*a*. The first conductive portion 62*a* and the second conductive portion 62*b* form a conductive pattern in the rotation plate 61. The movable contact plate 62 has one surface in the thicknesswise direction (surface shown in FIG. 6) that is flat and forms a sliding surface 62*c* against which the contact portions 52 and 55 of the first to third fixed contact terminals 41 to 43 slide. The other surface of the movable contact plate 62 in the thicknesswise direction (surface that is not shown in FIG. 6) defines a flat holding surface 62*d*.

The first conductive portion 62*a* includes a non-conductive void 62*e*, which extends outward in the radial direction and opens inward in the radial direction. The non-conductive void 62*e* is formed to have a width in the circumferential direction that increases outward in the radial direction. Further, the non-conductive void 62*e* is tab-like as viewed in the axial direction of the first conductive portion 62*a* (direction of the axis L of the rotation plate 61). The second conductive portion 62*b* extends outward in the radial direction from a section located outward in the radial direction from the non-conductive void 62*e* of the first conductive portion 62*a*. The second conductive portion 62*b* has a circumferential width that increases outward in the radial direction. Further, the second conductive portion 62*b* is tab-like as viewed in the axial direction of the first conductive portion 62*a* (direction of the axis L of the rotation plate 61).

The holding member 63 is used to fix the movable contact plate 62 and formed from an insulating resin material. The holding member 63 includes an engaging portion 63*a* arranged at the inner side of the first conductive portion 62*a*, that is, at a radially central part of the rotation plate 61. As illustrated in FIG. 2, the engaging portion 63*a* is cylindrical, has an open end at the side of the holding surface 62*d* and an opposite closed end, and projects from the sliding surface 62*c*. The inner diameter of the engaging portion 63*a* is slightly larger than the outer diameter of the fixing portion 14*b*. An insertion hole 63*b* extends through the center of the bottom of the engaging portion 63*a* in the direction of the axis L of the rotation plate 61 The diameter of the insertion hole 63*b* is slightly larger than the outer diameter of the support pin 12*a*.

As illustrated in FIG. 6, the holding member 63 includes a non-conductive portion 63*c*, which extends outward in the radial direction from the open end of the engaging portion 63*a* and fills the non-conductive void 62*e*. The non-conductive portion 63*c* includes an end surface at the side of the sliding surface 62*c* (i.e., front surface of the rotation plate 61) that is flat and projects outward from the sliding surface 62*c* (toward the front of the sliding surface 62*c* in FIG. 6).

The holding member 63 includes an arcuate outer circumference holding portion 63*d* that surrounds the outer circumference of the first conductive portion 62*a*. The outer circumference holding portion 63*d* continuously extends from one circumferential end of the second conductive portion 62*b* to the other end of the second conductive portion 62*b* along the outer circumference of the first conductive portion 62*a* outward in the radial direction from the first conductive portion 62*a*. The outer circumference holding portion 63*d* is formed integrally with the first conductive portion 62*a*. Specifically, the outer circumference holding portion 63*d* and the first conductive portion 62*a* are formed so as to be immovable relative to each other in the axial direction and the rotational direction (circumferential direction) of the rotation plate 61. An axial end surface of the outer circumference holding portion 63*d* at the side of the sliding surface 62*c* projects outward from the sliding surface 62*c*, which is the surface of the movable contact plate 62. Specifically, the front surface of the rotation plate 61 projects toward the front of the sliding surface 62*c* in FIG. 6. The outer circumference holding portion 63*d* forms an insulating pattern in the rotation plate 61 together with the non-conductive portion 63*c*. The contact portion 52 of the first fixed contact terminal 41 slides against the exposed surface (front surface) at the side of the sliding surface 62*c* in the non-conductive portion 63*c*, while the contact portion 52 of the third fixed contact terminal 43 slides against the exposed surface (front surface) at the side of the sliding surface 62*c* in the outer circumference holding portion 63*d*.

As illustrated in FIG. 2, the holding member 63 includes a plurality of ribs 63*e* having a meshed structure on the holding surface 62*d*. The ribs 63*e* are formed integrally with the movable contact plate 62 on the holding surface 62*d* to and hold and reinforce the movable contact plate 62. The holding member 63 projects toward the worm wheel 14 arranged to be opposed to the holding surface 62*d*. Specifically, the holding member 63 includes a plate-side engaging protrusion 63*f* that projects toward the worm wheel 14 from the holding surface 62*d* (surface opposed to the worm wheel 14 in the holding member 63) along the axis L. The plate-side engaging protrusion 63*f* comes into contact with the gear engagement protrusion 14*a* from the circumferential direction to rotate the rotation plate 61 with the worm wheel 14.

The rotation plate 61 has a smaller outer diameter smaller the worm wheel 14. The rotation plate 61 is supported to be rotatable relative to the support pin 12*a* of the second housing case 12 by having the sliding surface 62*c* be opposed to the second housing case 12 and fastening a toothed washer 64 to the support pin 12*a* in a state in which the support pin 12*a* is inserted into the insertion hole 63*b*. The second housing case 12 is coupled to the first housing case 11 thereby fitting the fixing portion 14*b* of the worm wheel 14 into the engaging portion 63*a*. The rotation centers of the worm wheel 14 and the rotation plate 61 lie along the axis L, and the worm wheel 14 and the rotation plate 61 are rotatable relative to each other as the outer circumferential surface of the fixing portion 14*b* slides against the inner circumferential surface of the engaging portion 63*a*. When the gear engagement protrusion 14*a* comes into contact with the plate-side engaging protrusion 63*f* from the circumferential direction, the torque of the worm wheel 14 is transmitted to the rotation plate 61 by the gear engagement protrusion 14*a* and the plate-side engaging protrusion 63*f*.

As illustrated in FIG. 6, in the gear housing 10, the distal end of the contact portion 52 of the first fixed contact terminal 41, the distal end of the contact portion 55 of the second fixed contact terminal 42, and the contact portion 52 of the third fixed contact terminal 43 respectively contact the surfaces of the rotation plate 61 (i.e., the sliding surface 62*c*, the surface of the non-conductive portion 63*c* at the same level as the sliding surface 62*c*, and the surface of the outer circumference holding portion 63*d* at the same level as the sliding surface 62*c* is provided). The elasticity of each of the first to third fixed contact terminals 41 to 43 presses the first to third fixed contact terminals 41 to 43 against the rotation plate 61 in the direction of the axis L. As the rotation plate 61 rotates, the contact portion 52 of the first fixed contact terminal 41 follows a first track T1 and contacts the non-conductive portion 63*c* or a section of the first conductive portion 62*a* near the inner circumference. Further, the contact portion 55 of the second fixed contact terminal 42 follows a second track T2 and contacts a section of the first conductive portion 62*a* outward in the radial direction from the non-conductive void 62*e*. Moreover, the contact portion 52 of the third fixed contact terminal 43 follows a third track T3 and contacts the second conductive portion 62*b* or the outer circumference holding portion 63*d*. Accordingly, in accordance with the rotational position of the rotation plate 61, the movable contact plate 62 electrically switches the connected combination of the first to third fixed contact terminals 41 to 43. This allows for switching or signal generation to be performed in accordance with the rotational position of the rotation plate 61.

As illustrated in FIG. 7, the wiper switch 45 includes a stop position P1, which is for stopping the motor 1 to stop the wiper W, a low-speed operation position P2, which is for operating the motor 1 at a low speed to produce a low-speed wiping action with the wiper W, and a high-speed operation position P3, which is for operating the motor 1 at a high speed to produce a high-speed wiping action with the wiper W at high speed.

The operation of the motor 1 of the present embodiment will now be described.

When the wiper switch 45 is located at the stop position P1 in a state in which the wiper W is arranged at the stop position along the lower end of the vehicle windshield, the first connection terminal 21*a* (first terminal member 21), which is connected with the high-speed power supplying brush B1 of the motor unit 2, and the second connection terminal 22*a* (second terminal member 22), which is connected with the low-speed power supplying brush B2, are not supplied with power from the battery power supply E. Accordingly, the armature 6 does not rotate in the motor unit 2, and the wiper W remains arranged at the stop position.

When the wiper switch 45 is switched to the low-speed operation position P2, power is supplied to the low-speed power supplying brush B2 from the battery power supply E through the second connection terminal 22*a* (second terminal member 22), regardless of the state of contact between the movable contact plate 62 of the rotation plate 61 and each of the fixed contact terminals 41 to 43. This rotates the armature 6 at a low speed. The worm 7*a* and the worm wheel 14 reduce the speed of the rotation of the armature 6 and transmit the rotation to the output shaft 15. As the output shaft 15 rotates, the wiper W produces a low-speed wiping action with the link mechanism (not illustrated) of the wiper device.

Here, during the wiping action of the wiper W (i.e., when the wiper W is located at a position other than the stop position), when the wiper switch 45 is switched to the stop position P1, the supply of power from the battery power supply E through the low-speed operation position P2 of the wiper switch 45 is stopped. However, a power supply path to the low-speed power supplying brush B2 is formed by the first fixed contact terminal 41, the movable contact plate 62, and the second fixed contact terminal 42. This continues to drive the motor unit 2 and continues the wiping action of the wiper W. When the wiper W reaches the stop position, the connection of the first fixed contact terminal 41 and the second fixed contact terminal 42 through the movable contact plate 62 is switched to the connection of the second fixed contact terminal 42 and the third fixed contact terminal 43. This stops driving the motor unit 2 and automatically stops the wiping action of the wiper W.

Further, when the wiper switch 45 is switched to the high-speed operation position P3, power is supplied from the battery power supply E to the high-speed power supplying brush B1 through the first connection terminal 21*a* (first terminal member 21), regardless of the state of contact between the movable contact plate 62 of the rotation plate 61 and each of the fixed contact terminals 41 to 43. As a result, the high-speed rotation of the motor unit 2 is output from the output shaft 15 through the reduction gear mechanism 13. The rotation of the output shaft 15 produces a high-speed wiping action with the wiper W. During the high-speed operation of the wiper W, even when the wiper switch 45 is switched to the stop position P1 during the wiping action of the wiper W, the rotation plate 61 and the fixed contact terminals 41 to 43, the supply of power to the motor 1 is continued to move the wiper W to the stop position. When the wiper W reaches the stop position, the motor 1 is automatically stopped.

In this matter, in the motor 1 of the present embodiment, the rotational position of the output shaft 15 (i.e., the position of the wiper W) is detected based on the contact position of the three fixed contact terminals 41 to 43 relative to the rotation plate 61, which is rotated by the worm wheel 14. Further, power is supplied to the motor unit 2 in accordance with the detected rotational position. This changes the power supply mode.

Figure 8:
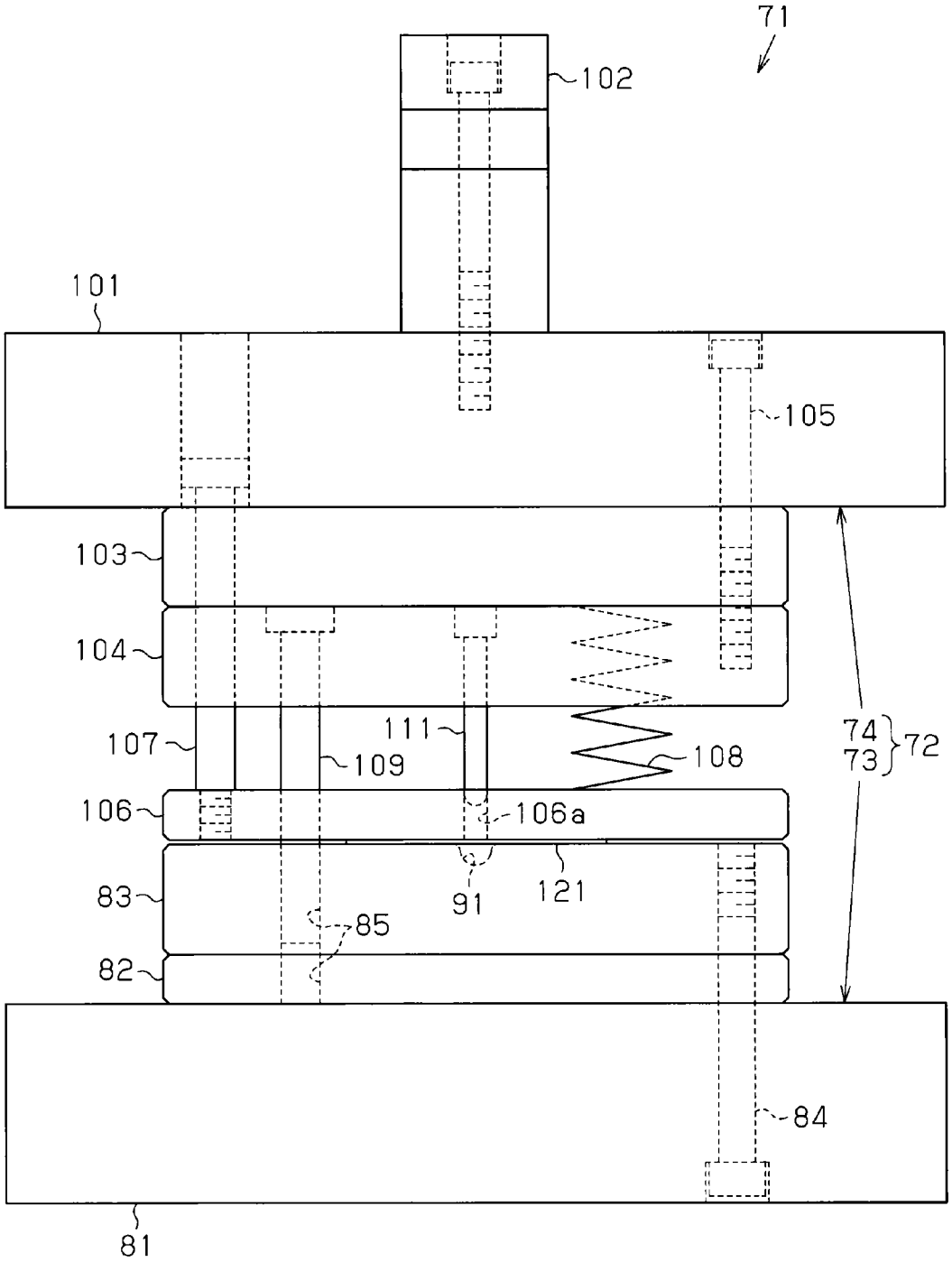
FIGS. 8 and 9 are schematic diagrams of an apparatus for manufacturing the first and third fixed contact terminals.

With reference to FIGS. 8 to 11, a manufacturing apparatus 71 that manufactures the first fixed contact terminal 41 and the third fixed contact terminal 43 will be described. As illustrated in FIG. 8, the manufacturing apparatus 71 includes dies 72, which are driven by a pressing machine (not illustrated). The dies 72 includes a lower die 73 and an upper die 74, which is arranged above the lower die 73.

The lower die 73 will first be described. A lower backing plate 82 is arranged on an upper surface of a plate-like lower die set 81, which forms the lower die 73. A die plate 83 is arranged on the upper surface of the lower backing plate 82. The lower backing plate 82 and the die plate 83 are fixed to the lower die set 81 by a first bolt 84.

Figure 9:
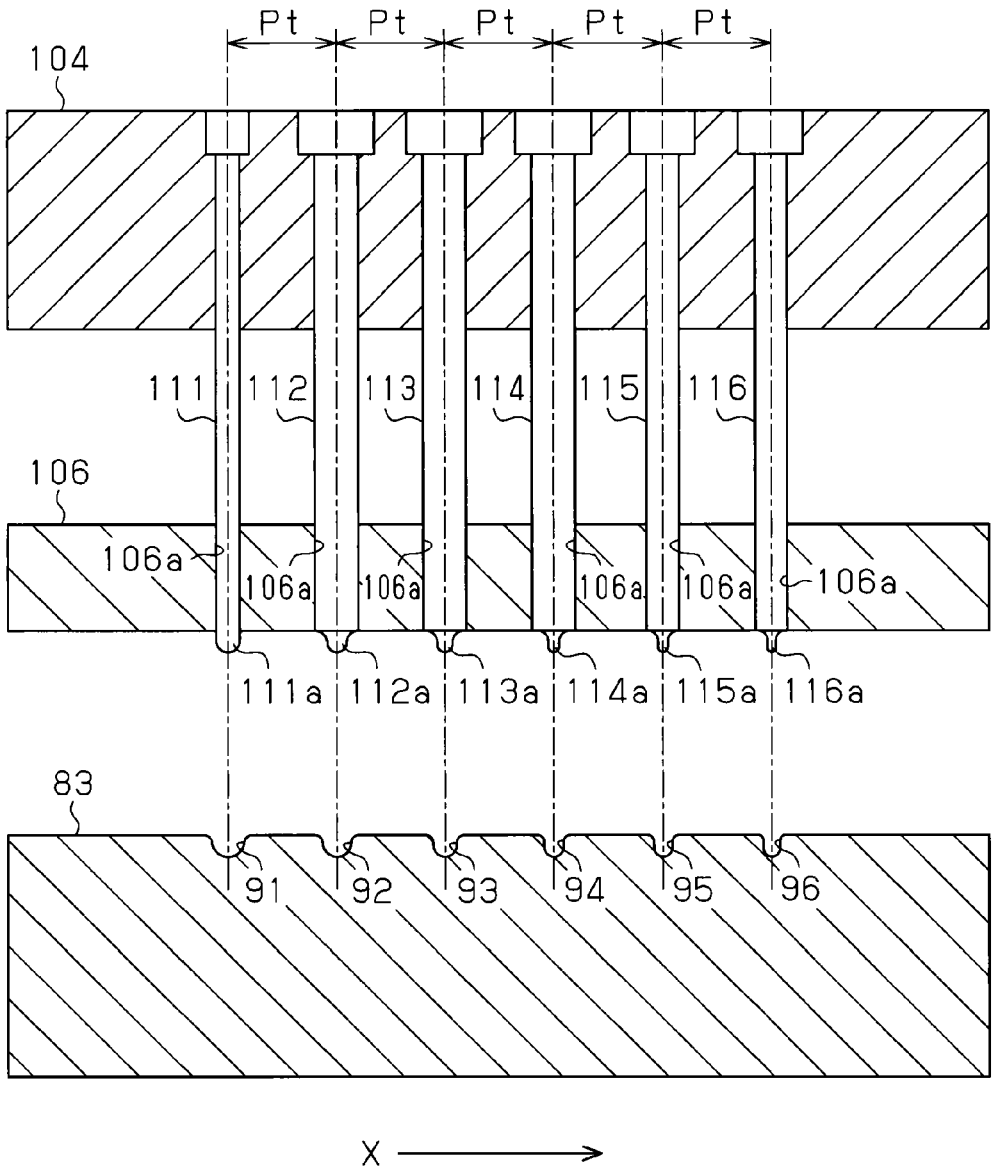

As illustrated in FIG. 9, six types of die cavities 91 to 96, namely, the first to sixth die cavities 91 to 96, are formed in the upper surface of the die plate 83. FIG. 8 shows only the first die cavity 91.

Next, the upper die 74 will be described. As illustrated in FIG. 8, a plate-shaped upper die set 101 forms the upper die 74. A pressing machine fixing jig 102 is fixed to the upper surface of the upper die set 101, which is connected to the pressing machine (not illustrated) by the pressing machine fixing jig 102 and vertically moved by the pressing machine. An upper backing plate 103 is arranged below the upper die set 101 in contact with the lower surface of the upper die set 101. A punch plate 104 is arranged below the upper backing plate 103 in contact with the lower surface of the upper backing plate 103. The upper backing plate 103 and the punch plate 104 are fixed to the upper die set 101 by a second bolt 105.

As illustrated in FIG. 9, the punch plate 104 holds six types of punches 111 to 116, namely, the first to sixth punches 111 to 116. FIG. 8 shows only the first punch 111. Each of the first to sixth punches 111 to 116 is cylindrical in shape and vertically extends through the punch plate 104. Vertical motion of the upper die set 101 vertically moves the upper backing plate 103 and the punch plate 104.

As illustrated in FIG. 8, a stripper plate 106, which is vertically opposed to the die plate 83, is arranged below the punch plate 104. A stripper bolt 107, which extends through the upper die set 101, the upper backing plate 103, and the punch plate 104, is fastened to the stripper plate 106. The stripper bolt 107 supports the stripper plate 106 to be vertically movable relative to the upper die set 101 and the upper backing plate 103. A spring 108, which is arranged between the upper backing plate 103 and the stripper plate 106 and extends through the punch plate 104, urges the stripper plate 106 downward toward the die plate 83. The stripper plate 106 moves down as the upper die set 101 moves down to hold a metal plate 121, which is arranged on the upper surface of the die plate 83 to form the first fixed contact terminal 41 and the third fixed contact terminal 43, with the die plate 83 in between.

As illustrated in FIG. 9, the stripper plate 106 includes a plurality of insertion holes 106*a* through which the first to sixth punches 111 to 116 are inserted. Each insertion hole 106*a* vertically extends through the stripper plate 106 and has a circular cross-section shape that is perpendicular to the vertical direction. Each insertion hole 106*a* has an inner diameter that is substantially equal to the outer diameter of the inserted first to sixth punches 111 to 116.

As illustrated in FIG. 8, the punch plate 104 holds a guide pin 109. The guide pin 109 vertically extends through the punch plate 104 and the stripper plate 106. A guide hole 85 vertically extends through the die plate 83 and the lower backing plate 82 of the lower die 73. A distal part of the guide pin 109 is inserted into the guide hole 85. The guide pin 109 positions the insertion holes 106*a* and the first to sixth punches 111 to 116 in a direction perpendicular to the vertical direction. The guide pin 109 is vertically moved with the punch plate 104 as the upper die set 101 vertically moves, while being guided by the wall of the guide hole 85. The stripper plate 106 is relatively movable in the vertical direction relative to the guide pin 109, while being guided by the guide pin 109. As illustrated in FIG. 8, each of the first to sixth punches 111 to 116 is inserted into and removed from the corresponding insertion holes 106*a* when moved relative to the stripper plate 106 in the vertical direction.

The first to sixth die cavities 91 to 96 and first to sixth punches 111 to 116 will now be described in detail.

As illustrated in FIG. 9, the first to sixth die cavities 91 to 96 are formed in the upper surface of the die plate 83 at a predetermined pitch Pt in a feeding direction X in which the metal plate 121 is fed and arranged in the order of the first die cavity 91, the second die cavity 92, the third die cavity 93, the fourth die cavity 94, the fifth die cavity 95, and the sixth die cavity 96. The predetermined pitch Pt is set in accordance with the length of the first fixed contact terminal 41 (or the third fixed contact terminal 43) that is to be formed. The first to sixth die cavities 91 to 96 are arranged along a straight line in the feeding direction X. Further the upper surface of the die plate 83 includes die cavities of the same type (e.g., four first die cavities 91) arranged along a straight line in the direction perpendicular to the feeding direction X (in the direction perpendicular to the plane of FIG. 9). The first to sixth die cavities 91 to 96 are arranged in the direction perpendicular to the feeding direction X at a predetermined pitch in accordance with the width in the direction perpendicular to the longitudinal direction of the first fixed contact terminal 41 (or the third fixed contact terminal 43) that is to be formed.

Figure 10A:
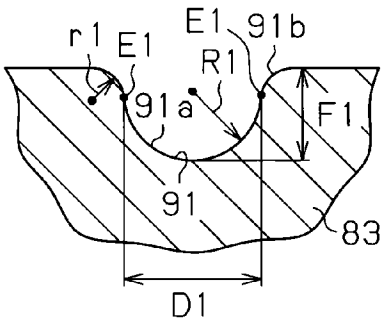
FIGS. 10A to 10F are cross-sectional views each illustrating a die cavity.
Figure 10B:
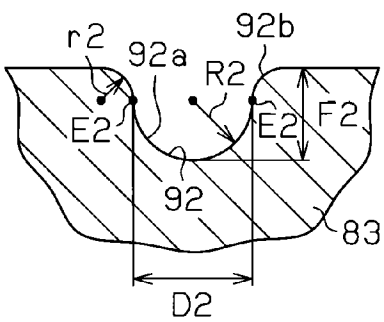
Figure 10C:
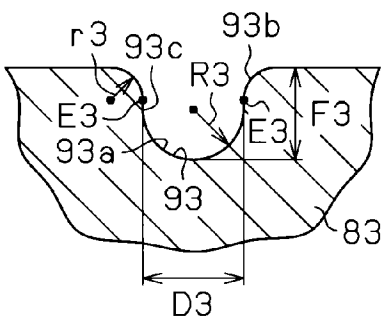
Figure 10D:
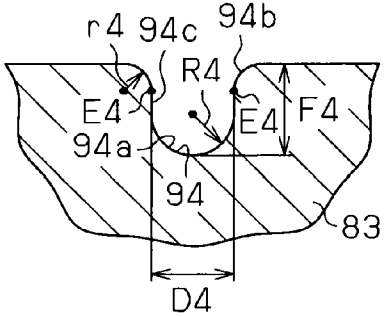
Figure 10E:
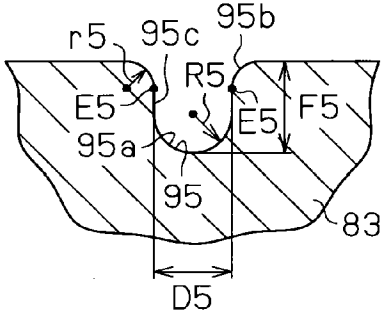

As illustrated in FIG. 10A, the first die cavity 91 is recessed to have a semispherical shape. With reference to FIGS. 5C and 10A, the first die cavity 91 has a depth F1 equal to the height H of the contact portion 52 in the first fixed contact terminal 41 (or the third fixed contact terminal 43). The wall of the first die cavity 91 is a first recessed semispherical surface 91*a*. The first recessed semispherical surface 91*a* has a radius R1 (curvature radius) that is larger than the radius R (curvature radius) of the surface of the semispherical distal part of the contact portion 52. The first die cavity 91 has an opening end that defines a first guide surface 91*b*. The first guide surface 91*b* is curved and has a radius r1, which is fixed throughout the entire circumference of the open end of the first die cavity 91. The first guide surface 91*b* rounds the open end of the first die cavity 91. Further, the first guide surface 91*b* smoothly connects the upper surface of the die plate 83 and the first recessed semispherical surface 91*a*. The first die cavity 91 has a diameter D1 that is larger than the diameter D of the contact portion 52. In the present embodiment, the diameter D1 is twice the value or greater of the diameter D of the contact portion 52. The diameter D1 of the first die cavity 91 is taken at an end E1 of the first guide surface 91*b* at the bottom side of the first die cavity 91 and is the maximum diameter in the first die cavity 91 excluding the first guide surface 91*b*.

As illustrated in FIGS. 5C and 10B to 10E, the second to fifth die cavities 92 to 95 respectively have depths F2 to F5 that are equal to the depth F1 of the first die cavity 91. The second to fifth recessed semispherical surfaces 92*a* to 95*a* respectively have radii R2 to R5 that are greater than the radius R of the contact portion 52 and smaller than the radius R1 of the first recessed semispherical surface 91*a*, and the radii R2 to R5 decrease in this order. The open ends of the second to fifth die cavities 92 to 95 respectively includes second to fifth guide surfaces 92*b* to 95*b* that are similar to the first guide surface 91*b*. The second and third guide surfaces 92*b* and 93*b* respectively have radii r2 and r3 that are equal to the radius r1 of the first guide surface 91*b*. The fourth and fifth guide surfaces 94*b* and 95*b* respectively have radii r4 and r5 that are equal to each other and smaller than the radius r1 of the first guide surface 91*b*. Among the second to fifth die cavities 92 to 95, the walls of the third to fifth die cavities 93 to 95 include cylindrical connecting surfaces 93*c* to 95*c*, which connect the third to fifth recessed semispherical surfaces 93*a* to 95*a* with the third to fifth guide surfaces 93*b* to 95*b*, respectively. The second to fifth die cavities 92 to 95 respectively have diameters D2 to D5 that are larger than the diameter D of the contact portion 52, and the diameters D2 to D5 gradually decrease in this order.

Figure 10F:
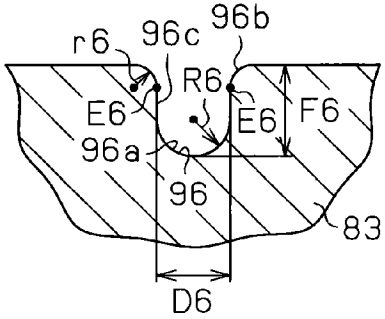

As illustrated in FIGS. 5C and 10F, the wall of the sixth die cavity 96 has a shape that conforms to the outer circumferential surface of the contact portion 52. The sixth die cavity 96 has a depth F6 that is equal to the depth F1 of the first die cavity 91. The sixth die cavity 96 has a radius R6 that is smaller than the radius R5 of the fifth recessed semispherical surface 95*a* and equal to the radius R of the contact portion 52. The sixth die cavity 96 includes an open end that defines a sixth guide surface 96*b* similar to the first guide surface 91*b*. The sixth guide surface 96*b* includes a radius r6 that is smaller than the radius r5 of the fifth guide surface 95*b*. The wall of the sixth die cavity 96 includes a cylindrical connecting surface 96*c* that connects the sixth recessed semispherical surface 96*a* and the sixth guide surface 96*b*. The sixth die cavity 96 has a diameter D6 that is smaller than the diameter D5 of the fifth die cavity 95 and equal to the diameter D of the contact portion 52. Specifically, the diameter D6 of the sixth die cavity 96 is smaller than or equal to one half the diameter D1 of the first die cavity 91.

As described above, the first to sixth die cavities 91 to 96 have the same depth and diameters that gradually decrease in the feeding direction X. The radii of the first to sixth guide surfaces 91*b* to 96*b* decrease in a stepwise manner in the feeding direction X.

As illustrated in FIG. 9, the first to sixth punches 111 to 116 are held on the punch plate 104 so that the first punch 111, the second punch 112, the third punch 113, the fourth punch 114, the fifth punch 115, and the sixth punch 116 are arranged in this order at the pitch Pt along the feeding direction X in the same manner as the first to sixth die cavities 91 to 96. The first to sixth punches 111 to 116 are arranged along a straight line in the feeding direction X. Punches of the same type (for example, four first punches 111) are arranged in the direction perpendicular to the feeding direction X (in the perpendicular direction in FIG. 9). The first to sixth punches 111 to 116 arranged in the direction perpendicular to the feeding direction X are held on the punch plate 104 at a predetermined pitch in accordance with the width in the direction perpendicular to the longitudinal direction of the first fixed contact terminal 41 (or third fixed contact terminal 43) that is to be formed. The distal parts of the first to sixth punches 111 to 116 are vertically opposed to the first to sixth die cavities 91 to 96, respectively. The distal ends of the first to sixth punches 111 to 116 held on the punch plate 104 are located at the same height.

Figure 11A:
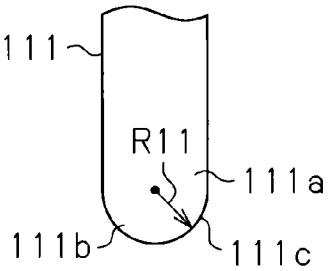
FIGS. 11A to 11F are partial enlarged views each illustrating a punch.
Figure 11B:
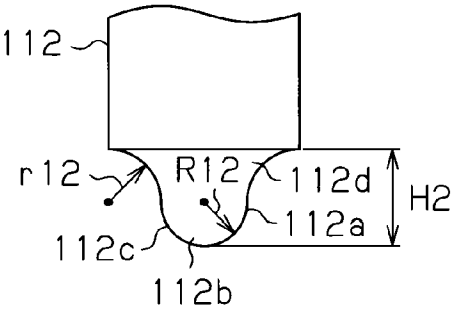
Figure 11C:
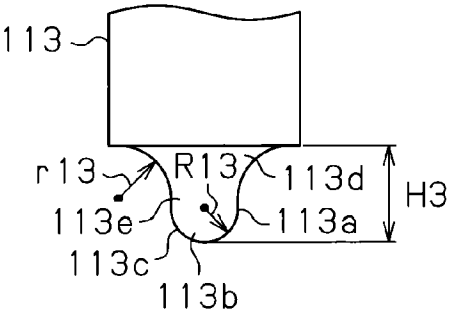
Figure 11D:
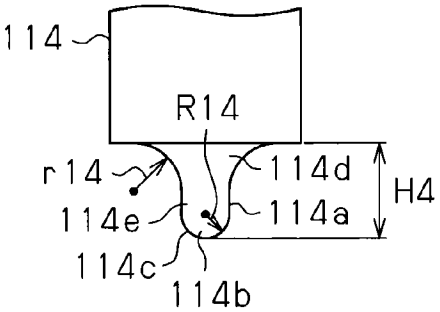
Figure 11E:
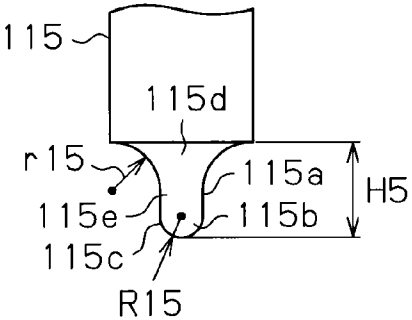
Figure 11F:
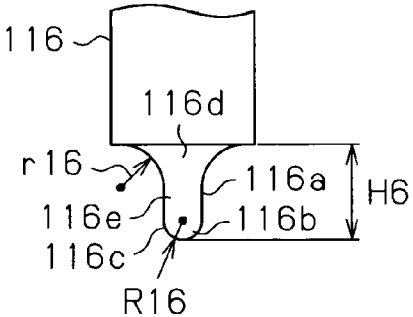

Referring to FIGS. 10A and 11A, the distal part of the first punch 111 defines a semispherical first punching portion 111*a*. The contour of the first punching portion 111*a* is smaller than the contour of the first die cavity 91. The distal part of the first punching portion 111*a* defines a first semispherical portion 111*b*. The outer surface of the first semispherical portion 111*b* defines a first bulged semispherical surface 111*c* having a radius R11 (curvature radius) that is smaller than the radius R1 of the first recessed semispherical surface 91*a*.

As illustrated in FIGS. 5C and 10B to 11F, the contour of each of second to sixth punching portions 112*a* to 116*a* defined by the distal parts of the second to sixth punches 112 to 116 is smaller than the contour of the corresponding one of the second to sixth die cavities 92 to 96. The contour of the sixth punching portion 116*a* is the same as the contour of the contact recess 54. The second to sixth punching portions 112*a* to 116*a* respectively have heights H2 to H6 that are equal to the depth F of the contact recess 54. Second to sixth bulged semispherical surfaces 112*c* to 116*c* at the distal parts of the second to sixth punching portions 112*a* to 116*a* respectively have radii R12 to R16 that are smaller than the radii R2 to R6 of the second to sixth recessed semispherical surfaces 92*a* to 96*a* (smaller by an amount corresponding to the thickness of the contact portion 52). The radii R11 to R16 gradually decrease in this order. The regions of the second to sixth punching portions 112*a* to 116*a* located toward the basal end from second to sixth semispherical portions 112*b* to 116*b* define second to sixth guide portions 112*d* to 116*d* having a diameter that gradually increases toward the basal end. The outer surfaces of the second to sixth guide portions 112*d* to 116*d* are curved inward and respectively have radii r12 to r16 that are larger than the radii r2 to r6 of the second to sixth guide surfaces 92*b* to 96*b* (larger by the amount corresponding to the thickness of the contact portion 52). The radius r12 and the radius r13 are equal. The radius r14 is smaller than the radius r13. The radius r15 and the radius r14 are equal. The radius r16 is smaller than the radius r15. The second to sixth guide portions 112*d* to 116*d* are smoothly connected to the second to sixth bulged semispherical surfaces 112*c* to 116*c*. Among the second to sixth punching portions 112*a* to 116*a*, cylindrical connection portions 113*e* to 116*e* are respectively formed between the third to sixth semispherical portions 113*b* to 116*b* of the third to sixth punching portions 113*a* to 116*a* and the third to sixth guide portions 113*d* to 116*d*.

As described above, the heights H2 to H6 of the sixth punching portions 112*a* to 116*a* are equal. The diameters of the first to sixth punching portions 111*a* to 116*a* gradually decrease in the feeding direction X. Further, the radius of the second to sixth guide portions 112*d* to 116*d* decrease in a stepwise manner in the feeding direction.

As illustrated in FIGS. 9 to 10F and 15, each insertion hole 106*a*, which is opposed to the second die cavity 92 in the stripper plate 106 and through which the second punch 112 is inserted, has a diameter Ds that is greater than or equal to the sum of the diameter D2 of the second die cavity 92 and twice the value of the radius r2 of the second guide surface 92*b*. In the same manner, the insertion holes 106*a* opposed to the third to sixth die cavities 93 to 96 in the stripper plate 106 each have a diameter Ds that is greater than or equal to the sum of the corresponding diameters D3 to D6 of the opposed third to sixth die cavities 93 to 96 and twice the value of the corresponding radii r3 to r6 of the third to sixth guide surfaces 93*b* to 96*b*, which are defined at the opening ends of the opposed third to sixth die cavities 93 to 96.

A method for manufacturing the first and third fixed contact terminals 41 and 43 using the manufacturing apparatus 71 described above will now be described. The first and third fixed contact terminals 41 and 43 of the present embodiment are formed by performing an initial pressing process and first to fifth contraction pressing processes. The first to fifth contraction pressing processes form a contraction pressing process. The first and third fixed contact terminals 41 and 43 of the present embodiment are formed by a forward feeding pressing process.

Figure 12:
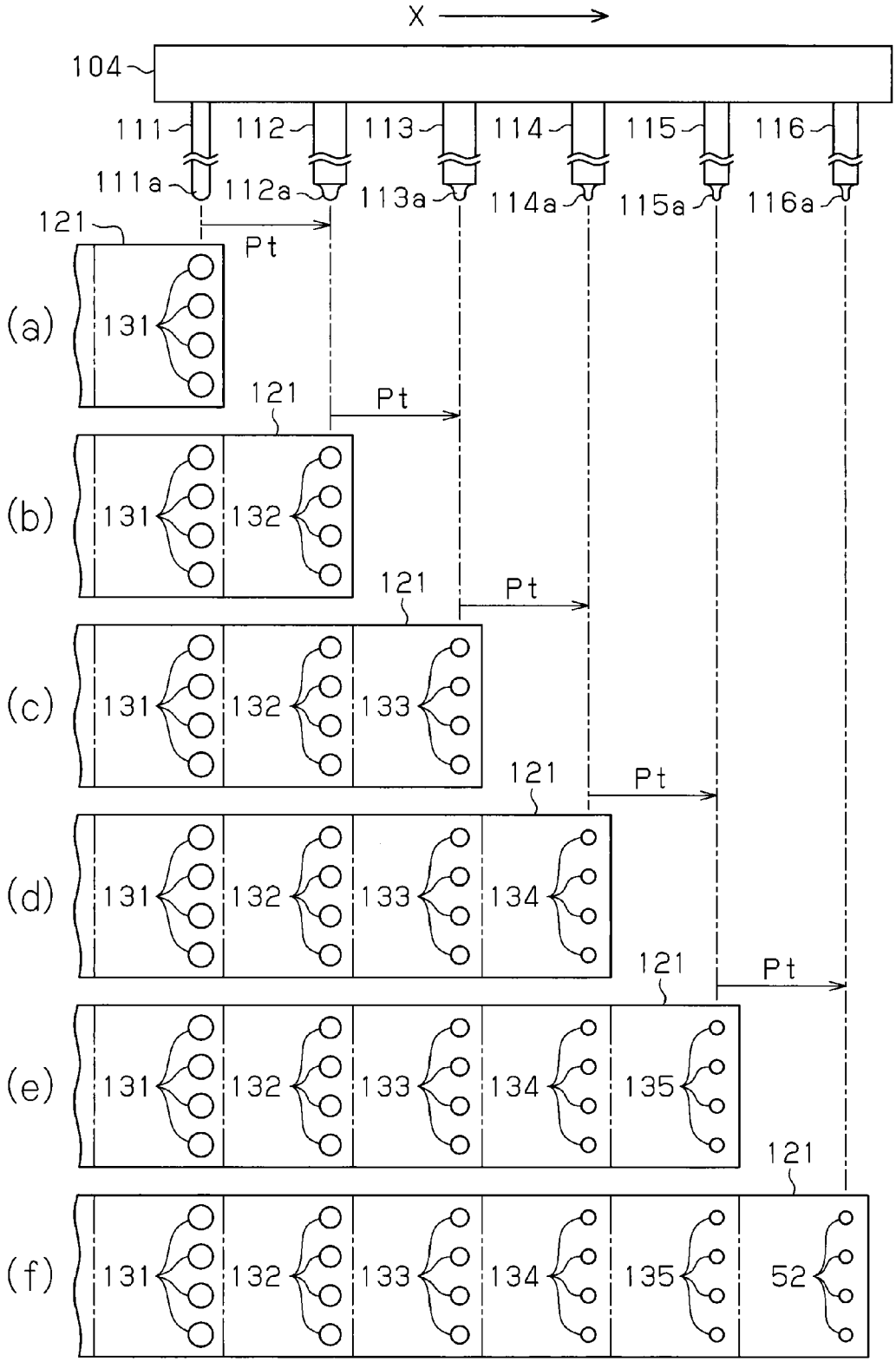
FIG. 12 is a schematic diagram illustrating a method for manufacturing the first and third fixed contact terminals.

Referring to FIGS. 8, 9, and 12, in the initial pressing process, the metal plate 121, which is fed to the manufacturing apparatus 71 in the feeding direction X by a conveying device (not illustrated), is first arranged on the upper surface of the die plate 83. In this state, the upper die set 101 is lifted by the pressing machine, and the stripper plate 106 is separated from the upper surface of the die plate 83 by a distance that is greater than or equal to the thickness of the metal plate 121. The metal plate 121 is arranged on the upper surface of the die plate 83 thereby closing each first die cavity 91.

Then, the upper die set 101 is lowered by the pressing machine. When the upper die set 101 is lowered, the stripper plate 106 first comes into contact with the metal plate 121. Then, the upper backing plate 103 is lowered to decrease the distance from the stripper plate 106 and compress the spring 108 between the stripper plate 106 and the upper backing plate 103. As a result, the spring 108 urges the stripper plate 106 toward the die plate 83. This holds and clamps the metal plate 121 between the stripper plate 106 and the die plate 83. Then, the first punching portion 111*a* of each first punch 111 is inserted through the corresponding insertion hole 106*a* and fitted into the first die cavity 91. This plastically deforms and extends the metal plate 121 into the first die cavity 91. As a result, the pressing of the metal plate 121 with each first punch 111 and the corresponding first die cavity 91 performs a drawing process that forms projections 131 in the metal plate 121 that project in the thicknesswise direction of the metal plate 121, as illustrated in FIG. 12(*a*).

Then, referring to FIGS. 8, 9, and 12, the upper die set 101 is lifted by the pressing machine. When the upper die set 101 is lifted, each first punch 111 is lifted together with the upper backing plate 103 and the punch plate 104. This separates the first punching portion 111*a* of the first punch 111 from the inner circumferential surface of the corresponding projection 131. Then, the punch plate 104 and the upper backing plate 103 are lifted from the stripper plate 106. This gradually extends the spring 108 and removes each first punch 111 from the corresponding insertion hole 106*a* in the upward direction. Further, when a head portion of the stripper bolt 107 comes into contact with the upper surface of the upper backing plate 103, the stripper plate 106 is lifted together with the upper backing plate 103 and the punch plate 104. This releases the metal plate 121 from the stripper plate 106 and the die plate 83. When the distance between the stripper plate 106 and the upper surface of the die plate 83 becomes greater than the thickness of the metal plate 121 that includes the projection 131, the lifting of the upper die set 101 is stopped. This ends the initial pressing process.

Each projection 131 formed in the initial pressing process includes an outer circumferential surface shaped in conformance with the inner circumferential surface of the first die cavity 91. The basal part of the projection 131 is plastically deformed in a gradual manner along the first guide surface 91*b* of the corresponding first die cavity 91. The diameter of the projection 131 (maximum diameter at the part located at the distal side of the arc-shaped outer circumferential surface formed along the first guide surface 91*b*) is equal to the diameter D1 of the first die cavity 91. Accordingly, the diameter of the projection 131 is twice the value of the diameter D of the contact portion 52 and larger than the diameter D2 of the second die cavity 92. Further, the height of the projection 131 (projecting amount from the flat part of the metal plate 121) is equal to the height H of the contact portion 52. The inner circumferential surface of the projection 131 is shaped in conformance with the outer circumferential surface of the first punching portion 111*a*.

Figure 13:
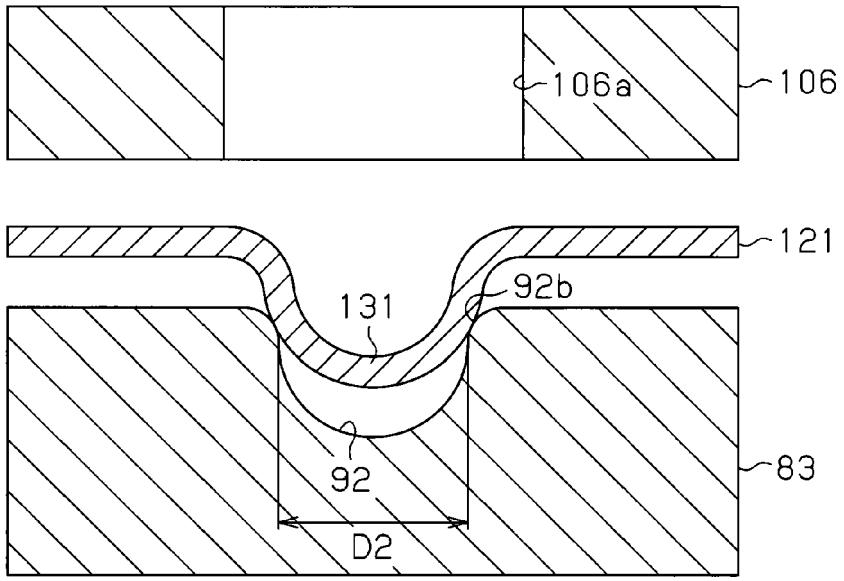
FIGS. 13 to 16 are schematic diagrams illustrating a method for manufacturing the first and third fixed contact terminals.

In a first contraction pressing process, the conveying device (not illustrated) feeds the metal plate 121 by the predetermined pitch Pt in the feeding direction X and moves the projections 131 formed in the initial pressing process from above the first die cavities 91 to above the second die cavities 92. As illustrated in FIG. 13, the diameter of each projection 131 is larger than the diameter D2 of each second die cavity 92. Thus, only the distal part of the projection 131 can be inserted into the second die cavity 92. The peripheral portion of the projection 131 in the metal plate 121 is slightly separated from the upper surface of the die plate 83 between the die plate 83 and the stripper plate 106.

Figure 14:
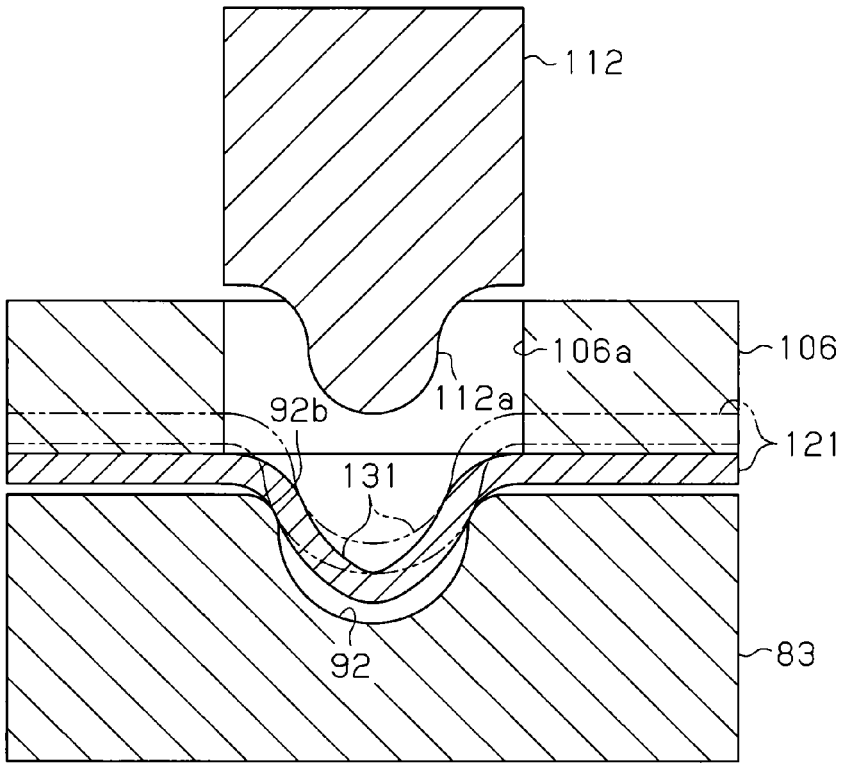
Figure 15:
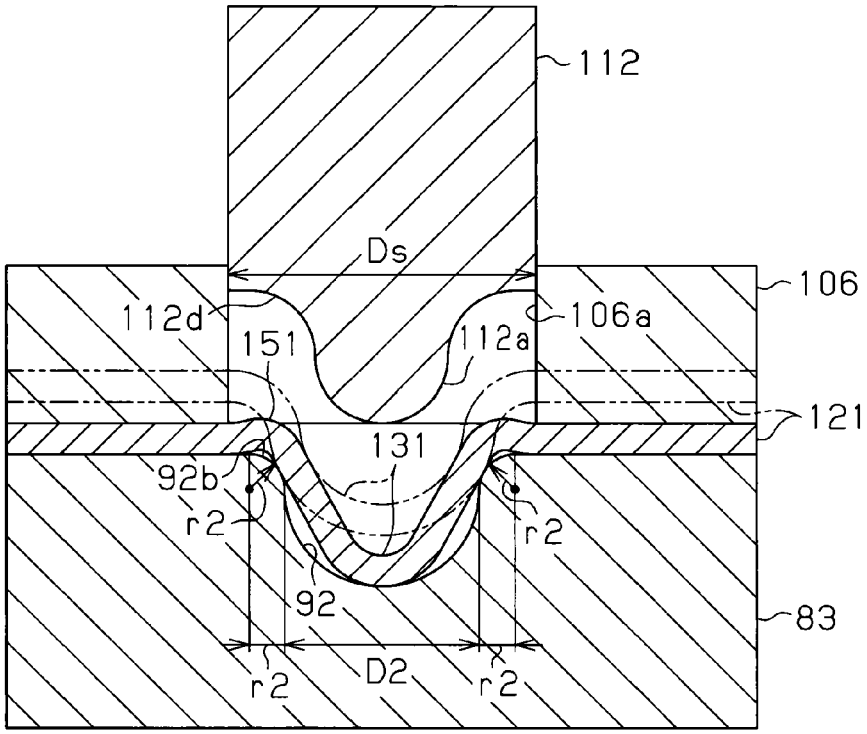

Then, in the same manner as in the initial pressing process, the upper die set 101 is lowered by the pressing machine. This lowers the stripper plate 106 that comes into contact with the metal plate 121. Then, the metal plate 121 is further forced downward toward the die plate 83 until the metal plate 121 comes into contact with the die plate 83. In this state, as illustrated in FIG. 14, at the peripheral portion of each insertion hole 106*a* in the stripper plate 106, the peripheral portion of the corresponding projection 131 in the metal plate 121 (the region opposed to the peripheral portion of the corresponding second die cavity 92 in the die plate 83 in the metal plate 121) is pressed against the die plate 83. This presses the basal part of the projection 131 against the second guide surface 92*b* at the open end of the second die cavity 92. As illustrated in FIGS. 14 and 15, the outer circumferential surface at the basal part of the projection 131 is pressed downward against the second guide surface 92*b*. This plastically deforms the projection 131 so that its diameter is decreased along the second guide surface 92*b* as the projection 131 is fitted into the second die cavity 92. The metal plate 121 indicated by broken lines in FIGS. 14 and 15 shows the state before it is pressed against the die plate 83 by the stripper plate 106. As illustrated in FIG. 15, the stripper plate 106 is lowered until the peripheral portion of the projection 131 in the metal plate 121 is held between the peripheral portion of the insertion hole 106*a* in the stripper plate 106 and the peripheral portion of the second die cavity 92 in the die plate 83. This forces substantially the entire projection 131 including the basal part into the second die cavity 92. At the same time, the diameter of the projection 131 becomes smaller than the diameter D2 of the second die cavity 92, and the projection 131 is plastically deformed into a conical shape so that the diameter gradually decreases toward the distal end. When the peripheral portion of the projection 131 in the metal plate 121 is held between the peripheral portion of the insertion hole 106*a* in the stripper plate 106 and the peripheral portion of the second die cavity 92 in the die plate 83, a bulging portion 151, which is spaced apart from the second guide surface 92*b* and bulges toward the insertion hole 106*a*, is formed at the basal part of the projection 131. The bulging portion 151 is formed at the basal part of the projection 131 when the metal plate 121 is held between the stripper plate 106 and the die plate 83. The diameter Ds of the insertion hole 106*a*, through which the second punch 112 is inserted, is greater than or equal to the sum of the diameter D2 of the second die cavity 92 and twice the value of the radius r2 of the second guide surface 92*b*. As a result, the bulging portion 151 is formed in the basal part of the projection 131 when the metal plate 121 is held between the stripper plate 106 and the die plate 83. The bulging portion 151 projects in an arc-shaped manner along the open end of the insertion hole 106*a* in the die plate 83. When the projection 131 is pressed against the open end of the second die cavity 92 (second guide surface 92*b* in the present embodiment) to plastically deform the projection 131, the second punching portion 112*a* of the second punch 112 is still located in the insertion hole 106*a* and does not contact the metal plate 121.

Figure 16:
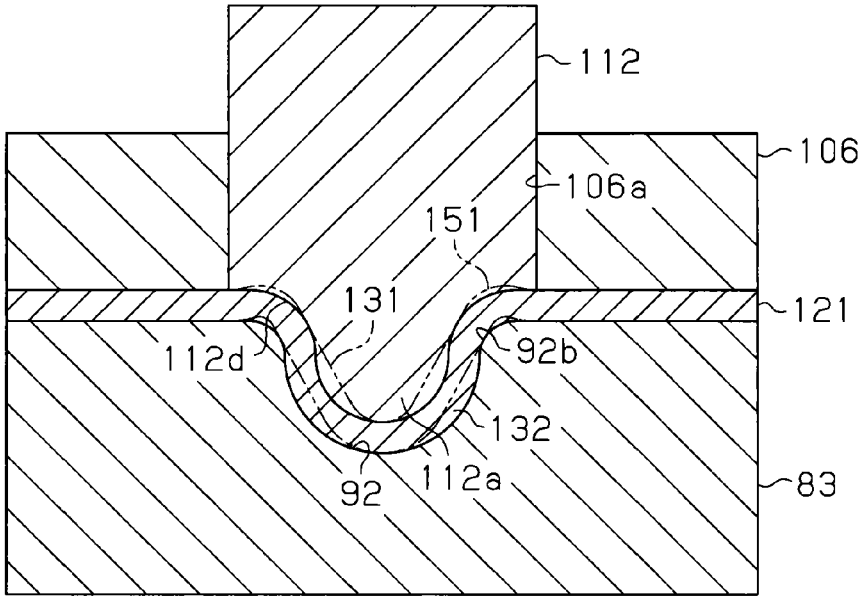

After the metal plate 121 is held between the stripper plate 106 and the die plate 83, the upper die set 101 is lowered thereby extending the second punching portion 112*a* of each second punch 112 through the insertion hole 106*a* and fitting the second punch 112 into the corresponding second die cavity 92 as illustrated in FIG. 16. In this state, the second punching portion 112*a* is fitted into the projection 131. The second punching portion 112*a* presses the conical projection 131 against the wall of the second die cavity 92 and plastically deforms the projection 131 from the inner side to increase the diameter of the projection 131 while pressing the bulging portion 151 against the second guide surface 92*b* with the second guide portion 112*d*. In this manner, the pressing process is performed on each projection 131 with the second punch 112 and the second die cavity 92. Referring to FIGS. 12(*b*) and 16, the pressing process obtains, from each projection 131 formed in the initial pressing process, the projection 132 that has an outer circumferential surface shaped in conformance with the inner circumferential surface of the second die cavity 92. The diameter of the projection 132, which is equal to the diameter D2 of the second die cavity 92, is smaller than the diameter of the projection 131, which is formed by the initial pressing process and larger than the diameter D of the contact portion 52 (specifically, larger than the diameter D3 of the third die cavity 93). Further, the depth F1 of the first die cavity 91 is equal to the depth F2 of the second die cavity 92, the height of the projection 132 remains the same as the height of the projection 131 (i.e., the same height as the height H of the contact portion 52), which is formed in the initial pressing process. The inner circumferential surface of the projection 132 is shaped in conformance with the outer circumferential surface of the second punching portion 112*a*.

Then, in the same manner as in the initial pressing process, the upper die set 101 is lifted by the pressing machine. This separates the second punching portion 112*a* from the inner circumferential surface of the projection 132 and releases the metal plate 121 from the stripper plate 106 and the die plate 83. Then, the lifting the upper die set 101 is stopped to end the first contraction pressing process.

As illustrated in FIGS. 8, 9, and 12, in the same manner as the first contraction pressing process, in the second contraction pressing process, the conveying device (not illustrated) feeds the metal plate 121 by the predetermined pitch Pt in the feeding direction X to move the projections 132 formed in the first contraction pressing process from above the second die cavities 92 to above the third die cavities 93. The diameter of each projection 132 is larger than the diameter D3 of the corresponding third die cavity 93. Thus, only the distal part of the projection 132 can be fitted into the third die cavity 93. The peripheral portion of the projection 132 in the metal plate 121 is slightly spaced apart from the upper surface of the die plate 83.

Then, the upper die set 101 is lowered by the pressing machine, and the pressing process is performed on each projection 132 with the third punching portion 113*a* of the corresponding third punch 113 and the corresponding third die cavity 93. The operations of the stripper plate 106, the third punch 113, and the like when the pressing process is performed on the projection 132 are similar to the operations of the stripper plate 106, the second punch 112, and the like when the pressing process is performed on the projection 131 in the first contraction pressing process. When the pressing process is performed on the projection 132 with the third punching portion 113*a* and the third die cavity 93, the projection 132 is deformed in the same manner as when the projection 131 is deformed into the projection 132 in the first contraction pressing process. Then, as illustrated in FIG. 12(*c*), the pressing process obtains, from each projection 132, a projection 133 having an outer circumferential surface shaped in conformance with the inner circumferential surface of the third die cavity 93. The diameter of the projection 133, which is equal to the diameter D3 of the third die cavity 93, is smaller than the diameter of the projection 132, which is formed by the first contraction pressing process, and larger than the diameter D of the contact portion 52 (specifically, larger than a diameter D4 of the fourth die cavity 94). Further, the depth F3 of the third die cavity 93 is equal to the depth F2 of the second die cavity 92. Thus, the height of the projection 133 remains the same as the height of the projection 132 (i.e., the same height as the height H of the contact portion 52), which is formed by the first contraction pressing process. The inner circumferential surface of the projection 133 is shaped in conformance with the outer circumferential surface of the third punching portion 113*a*. After the projections 133 are formed, the upper die set 101 is lifted by the pressing machine in the same manner as in the first contraction pressing process. This ends the second contraction pressing process.

As illustrated in FIGS. 8, 9, and 12, in the same manner as in the first contraction pressing process, in the third contraction pressing process, the conveying device (not illustrated) feeds the metal plate 121 by the predetermined pitch Pt in the feeding direction X and moves the projections 133 formed in the second contraction pressing process from above the third die cavities 93 to above the fourth die cavities 94. The diameter of each projection 133 is larger than the diameter D4 of the corresponding fourth die cavity 94. Thus, only the distal part of the projection 133 can be fitted into the corresponding fourth die cavity 94. The peripheral portion of the projection 133 in the metal plate 121 is slightly spaced apart from the upper surface of the die plate 83.

Then, the upper die set 101 is lowered by the pressing machine, and the pressing process is performed on each projection 133 with the fourth punching portion 114*a* of the corresponding fourth punch 114 and the corresponding fourth die cavity 94. The operations of the stripper plate 106, the fourth punch 114, and the like when the pressing process is performed on the projection 133 are similar to the operations of the stripper plate 106, the second punch 112, and the like when the pressing process is performed on the projection 131 in the first contraction pressing process. When the pressing process is performed on the projection 133 with the fourth punching portion 114*a* and the fourth die cavity 94, the projection 133 is deformed in the same manner as when the projection 131 is deformed into the projection 132 in the first contraction pressing process. Then, as illustrated in FIG. 12(*d*), the pressing process obtains, from each projection 133, a projection 134 having an outer circumferential surface shaped in conformance with the inner circumferential surface of the fourth die cavity 94. The diameter of the projection 134, which is equal to the diameter D4 of the fourth die cavity 94, is smaller than the diameter of the projection 133, which is formed by the second contraction pressing process, and larger than the diameter D of the contact portion 52 (specifically, larger than the maximum diameter of the fifth die cavity 95). Further, the depth F4 of the fourth die cavity 94 is equal to the depth F3 of the third die cavity 93. Thus, the height of the projection 134 remains the same as the height of the projection 133 (i.e., the same height as the height H of the contact portion 52), which is formed by the second contraction pressing process. The inner circumferential surface of the projection 134 is shaped in conformance with the outer circumferential surface of the fourth punching portion 114*a*. After the projections 134 are formed, the upper die set 101 is lifted by the pressing machine in the same manner as in the first contraction pressing process. This ends the third contraction pressing process.

As illustrated in FIGS. 8, 9, and 12, in the same manner as in the first contraction pressing process, in the fourth contraction pressing process, the conveying device (not illustrated) feeds the metal plate 121 by the predetermined pitch Pt in the feeding direction X and moves the projections 134 formed in the third contraction pressing process from above the fourth die cavities 94 to above the fifth die cavities 95. The diameter of each projection 134 is larger than the diameter D5 of the corresponding fifth die cavity 95. Thus, only the distal part of the projection 134 can be fitted into the corresponding fifth die cavity 95. The peripheral portion of the projection 134 in the metal plate 121 is slightly spaced apart from the upper surface of the die plate 83.

Then, the upper die set 101 is lowered by the pressing machine, and the pressing process is performed on each projection 134 with the fifth punching portion 115*a* of the corresponding fifth punch 115 and the corresponding fifth die cavity 95. The operations of the stripper plate 106, the fifth punch 115, and the like when the pressing process is performed on the projection 134 are similar to the operations of the stripper plate 106, the second punch 112, and the like when the pressing process is performed on the projection 131 in the first contraction pressing process. When the pressing process is performed on the projection 134 with the fifth punching portion 115*a* and the fifth die cavity 95, the projection 134 is deformed in the same manner as when the projection 131 is deformed into the projection 132 in the first contraction pressing process. Then, as illustrated in FIG. 12(*e*), the pressing process obtains, from each projection 134, a projection 135 having an outer circumferential surface shaped in conformance with the inner circumferential surface of the fifth die cavity 95. The diameter of the projection 135, which is equal to the diameter D5 of the fifth die cavity 95, is smaller than the diameter of the projection 134, which is formed by the third contraction pressing process, and larger than the diameter D of the contact portion 52 (specifically, larger than the diameter D6 of the sixth die cavity 96). Further, the depth F5 of the fifth die cavity 95 is equal to the depth F4 of the fourth die cavity 94. Thus, the height of the projection 135 remains the same as the height of the projection 134 (i.e., the same height as the height H of the contact portion 52), which is formed by the third contraction pressing process. The inner circumferential surface of the projection 135 is shaped in conformance with the outer circumferential surface of the fifth punching portion 115*a*. After the projections 135 are formed, the upper die set 101 is lifted by the pressing machine in the same manner as in the first contraction pressing process. This ends the fourth contraction pressing process.

As illustrated in FIGS. 8, 9, and 12, in the same manner as in the first contraction pressing process, in the fifth contraction pressing process, the conveying device (not illustrated) feeds the metal plate 121 by the predetermined pitch Pt in the feeding direction X and moves the projections 135 formed in the fourth contraction pressing process from above the fifth die cavities 95 to above the sixth die cavities 96. The diameter of each projection 135 is larger than the diameter D6 of the corresponding sixth die cavity 96. Thus, only the distal part of the projection 135 can be fitted into the corresponding sixth die cavity 96. The peripheral portion of the projection 135 in the metal plate 121 is slightly spaced apart from the upper surface of the die plate 83.

Then, the upper die set 101 is lowered by the pressing machine, and the pressing process is performed on each projection 135 with the sixth punching portion 116*a* of the corresponding sixth punch 116 and the corresponding sixth die cavity 96. The operations of the stripper plate 106, the sixth punch 116, and the like when the pressing process is performed on the projection 135 are similar to the operations of the stripper plate 106, the second punch 112, and the like when the pressing process is performed on the projection 131 in the first contraction pressing process. When the pressing process is performed on the projection 135 with the sixth punching portion 116*a* and the sixth die cavity 96, the projection 135 is deformed in the same manner as when the projection 131 is deformed into the projection 132 in the first contraction pressing process. Then, as illustrated in FIG. 12(*f*), the pressing process obtains, from each projection 135, a contact 52 having an outer circumferential surface shaped in conformance with the inner circumferential surface of the sixth die cavity 96. The diameter D of the contact portion 52 is smaller than or equal to one half of the diameter of the projection 131 formed by the initial pressing process. After the contacts 52 are formed, the upper die set 101 is lifted by the pressing machine in the same manner as in the first contraction pressing process. This ends the fifth contraction pressing process.

After the fifth contraction pressing process, a pressing process is performed to punch out and bend the surrounding of each contact portion 52 from the metal plate 121 into a shape conforming to the shape of the first fixed contact terminal 41 (third fixed contact terminal 43). This completes the first fixed contact terminal 41 (third fixed contact terminal 43).

In the manufacturing apparatus 71, the initial pressing process and the first to fifth contraction pressing process are simultaneously performed on the metal plate 121 at six locations spaced apart by the predetermined pitch Pt in the feeding direction X. Further, pressing processes subsequent to the fifth contraction pressing process (i.e., the process for punching out the surrounding of each contact portion 52 from the metal plate 121 and the process for bending the punched out material) are performed at locations spaced apart by the predetermined pitch Pt in the feeding direction X. In this manner, whenever the upper die set 101 is lowered and lifted by the pressing machine, the metal plate 121 is fed by the predetermined pitch Pt in the feeding direction X to form the first fixed contact terminal 41 (third fixed contact terminal 43).

The present embodiment has the advantages described below.

(1) In the first to fifth contraction pressing processes, instead of performing the pressing process (drawing) to gradually increase the height of each of the projections 131 to 135, the pressing process is performed to gradually decrease the diameter of each of the projections 131 to 135 without changing the height of each of the projections 131 to 135. Accordingly, the projections 131 to 135 are not deformed to extend the metal material forming each of the projections 131 to 135 in the heightwise direction of the projections 131 to 135. This suppresses the formation of cracks in the projections 131 to 135 during the pressing in the first to fifth contraction pressing processes. The projection 131 formed with the first die cavity 91, which has a largest diameter among the plurality of die cavities 91 to 96, in the initial pressing process is formed with a diameter that is sufficiently larger than the contact portion 52. This prevents the projection 131, especially, at the distal part, from being plastically deformed such that the thickness is locally reduced. Further, even when the first to fifth contraction pressing processes and then performed to reducing the diameter of each projection 131, the height of each of the projections 132 to 135 is not increased. Thus, the distal part of each of the projections 132 to 135 remains thick, and the contact portion 52 can be formed without forming cracks. In this manner, the use of a discrete contact member is not necessary, and a contact portion 52 that is thin enough and has a sufficient height can be formed like when using a contact member without forming cracks.

(2) When performing pressing in the first to fifth contraction pressing processes, the metal plate 121 is held between the stripper plate 106 and the die plate 83, and the distal parts of the projections 131 to 135 are respectively pressed into the second to sixth die cavities 92 to 96 having the diameters D2 to D6, which are smaller than the diameters of the projections 131 to 135. At the open ends of the second to sixth die cavities 92 to 96, the arc-like second to sixth guide surfaces 92*b* to 96*b* are formed, respectively. Thus, the projections 131 to 135 are deformed so that their diameters are decreased along the second to sixth guide surfaces 92*b* to 96*b*, and the projections 131 to 135 are easily forced into the second to sixth die cavities 92 to 96. The radii r2 to r6 of the second to sixth guide surfaces 92*b* to 96*b* are set to decrease in a stepwise manner in latter processes. Thus, when the metal plate 121 is held between the stripper plate 106 and the die plate 83 in the first to fifth contraction pressing processes, the projections 131 to 135 are easily forced into the second to sixth die cavities 92 to 96, and the diameters of the projections 131 to 135 are easily decreased whenever pressing process is performed. This obtains contact portions 52 that are thin enough and have sufficient height like when using contact members.

(3) In the first to fifth contraction pressing process, when the metal plate 121 is held between the die plate 83 and the stripper plate 106, the edge of the open end of each insertion hole 106*a* in the die plate 83 is located outward in the radial direction from the second to sixth guide surfaces 92*b* to 96*b* formed at the edges of the open ends of the corresponding one of the second to sixth die cavities 92 to 96. Accordingly, in the first contraction pressing process, when the metal plate 121 is held between the die plate 83 and the stripper plate 106 in a state in which the distal part of the projection 131 is fitted into the second die cavity 92 having a smaller diameter than the projection 131, the bulging portion 151, which is spaced apart from the second guide surface 92*b* and bulged toward the insertion hole 106*a*, is formed at the basal part of the projection 131. When the second punch 112 extending through the insertion hole 106*a* is fitted into the second die cavity 92, the bulging portion 151 is pressed against the die plate 83 by the second guide portion 112*d* of the second punch 112 and forced into the second die cavity 92. Accordingly, when the pressing process is performed on the projection 131 with the second punch 112 and the second die cavity 92, extension of the metal material forming the projection 131 in the heightwise direction of the projection 131 is suppressed. This is the same for the second to fifth contraction pressing processes. Thus, the formation of cracks in the projections 131 to 135 during the first to fifth contraction pressing processes is suppressed.

(4) The projection 131 formed by the initial pressing process has a diameter that is greater than or equal to twice the value of the diameter of the contact portion 52 formed by pressing the projection 131 in the first to fifth contraction pressing processes. Thus, the projection 131 is formed with a diameter that is sufficiently larger than that of the contact portion 52. This easily prevents plastic deformation of the projection 131 in a state in which the projection 131 is locally thin, especially at the distal part. Further, the contact portion 52 has a diameter that is smaller than or equal to one half of the diameter of the projection 131. Thus, the contact portion 52 is thin.

(5) The second to sixth punching portions 112*a* to 116*a* of the second to sixth punches 112 to 116 used for the pressing (i.e., the first to fifth contraction pressing processes) to gradually decrease the diameter of the projection 131 are formed with equal heights H2 to H6. Thus, when the second to sixth punching portions 112*a* to 116*a* are respectively inserted into the second to sixth die cavities 92 to 96 to press the projections 131 to 135, the metal material that forms the projections 131 to 135 is arranged between the second to sixth punching portions 112*a* to 116*a* and the second to sixth die cavities 92 to 96 and prevented from being extended in the heightwise direction of the projections 131 to 135 by the second to sixth punching portions 112*a* to 116*a*. This suppresses the formation of cracks in the projections 131 to 135 during the pressing process (i.e., the first to fifth contraction pressing processes).

(6) Although a discrete contact member is not used to form the contact portion 52 of each the first and third fixed contact terminals 41 and 43, the contact portion 52 is thin and has a sufficient height like when using a discrete contact member. Further, the formation of cracks is prevented. Accordingly, in the motor 1 incorporating the first and third fixed contact terminals 41 and 43, the conductive state between the contact portion 52 and the rotation plate 61 can be quickly switched. Thus, when the wiper W is arranged at the stop position after the wiper switch 45 is deactivated, the connected state of the contact portion 52 and the rotation plate 61 can be quickly switched. Thus, the wiper W can easily be stopped at the desired stop position. Further, the first and third fixed contact terminals 41 and 43 are formed by the pressing process. This allows for a reduction in the manufacturing costs.

(7) The first and third fixed contact terminals 41 and 43 are formed only by the pressing process (including drawing). Accordingly, the first and third fixed contact terminals 41 and 43 can be formed in a forward feeding pressing process. This increases the productivity of the first and third fixed contact terminals 41 and 43 and reduces manufacturing costs.

(8) In the first to fifth contraction pressing processes, pressing process is performed on the projections 131 to 135 without changing the height of the projections 131 to 135. Thus, extension of the metal material forming each of the projections 131 to 135 in the heightwise direction of the projections 131 to 135 is suppressed. This suppresses the formation of cracks in the projections 131 to 135 during the first to fifth contraction pressing processes.

It should be apparent to those skilled in the art that the present invention may be embodied in many other specific forms without departing from the spirit or scope of the invention. Particularly, it should be understood that the present invention may be embodied in the following forms.

The first and third fixed contact terminals 41 and 43 may be used not only to detect the rotational position of the output shaft 15 of the motor 1 but also to detect the rotational position of an object that rotates integrally with the rotation plate 61.

In the embodiment described above, the first to sixth die cavities 91 to 96 are formed with the same depth, and the second to sixth punching portions 112*a* to 116*a* are formed with the same height. In the first to fifth contraction pressing processes, the pressing process is performed on the projections 131 to 135 without changing the height of the projections 131 to 135. However, the first to sixth die cavities 91 to 96 may be formed so that the depth is decreased in a stepwise manner in the feeding direction X, and the second to sixth punching portions 112*a* to 116*a* may be formed so that the height decreases in a stepwise manner in the feeding direction X. In this case, the depth F6 of the sixth die cavity 96 is set to be equal to the height H of the contact portion 52. In the first to fifth contraction pressing process, the projection undergoes pressing so as to decrease the height of the projection in a stepwise manner. Thus, in the first to fifth contraction pressing processes, extension of the metal material forming the projection in the heightwise direction of the projection is suppressed. This suppresses the formation of cracks in the projection during the first to fifth contraction pressing processes.

In the embodiment described above, the projection 131 formed in the initial pressing process has a diameter that is two times greater than the diameter D of the contact portion 52. However, the diameter of the projection 131 formed by the initial pressing process is not limited in such a manner as long as it is greater than the diameter D of the contact portion 52.

In the embodiment described above, among the radii r1 to r6 of the first to sixth guide surfaces 91*b* to 96*b*, the radii r1, r2, and r3 are set to be equal, the radii r4 and r5 are set to be equal and smaller than the radii r1, r2, and r3, and the radius r6 is set to be smaller than the radii r4 and r5. However, the radii r1 to r6 may all be different, and the values may be decreased in order in the feeding direction X (as the process progresses).

The number of the first to fifth contraction pressing processes (the number of pressing process) in the contraction pressing process is not limited to five as long as at least one contraction pressing process is performed. In this case, the number of die cavities and punches are set in accordance with the number of times the pressing process of the contraction pressing process is performed.

In the embodiment described above, the first and third fixed contact terminals 41 and 43 are formed by the forward feeding pressing process. However, the first and third fixed contact terminals 41 and 43 do not necessarily have to be formed by the forward pressing process as long as the first and third fixed contact terminals 41 and 43 can be formed by the pressing process.

The present examples and embodiments are to be considered as illustrative and not restrictive, and the invention is not to be limited to the details given herein, but may be modified within the scope and equivalence of the appended claims.

What is claimed is:

1. A method for manufacturing a contact terminal including a contact portion that slides against a surface of a conductive contact plate, the manufacturing method comprising:

forming the contact portion in a metal plate by performing a drawing process, wherein the contact portion projects in a thicknesswise direction of the metal plate and has a first diameter; and performing a contraction pressing process at least once on the contact portion so that the diameter of the contact portion gradually decreases, while the height of the contact portion remains the same or decreases in a stepwise manner, wherein the contact portion after performing the contraction pressing process has a second diameter that is smaller than the first diameter, the contraction pressing process includes:

preparing a die plate including a die cavity having a smaller diameter than the contact portion formed in a preceding process in at least one of the drawing process and the contraction pressing process;

arranging the metal plate on the die plate so that a distal part of the contact portion is fit into the die cavity;

preparing a stripper plate facing the die plate;

holding a peripheral portion of the contact portion facing a peripheral portion of the die cavity between the die plate and the stripper plate; and fitting a punch into the die cavity, the die cavity used in the contraction pressing process includes an open end that defines a guide surface having an arcuate cross-section, the stripper plate has an insertion hole through which the punch is inserted at a position opposed to the die cavity, the insertion hole has a diameter that is greater than or equal to the sum of the diameter of the opposed die cavity and twice a value of the radius of the guide surface, the die cavity in the die plate has a bottom, and when the peripheral portion of the contact portion in the metal plate is held between the peripheral portion of the die cavity in the die plate and a peripheral portion of the insertion hole in the stripper plate, a bulging portion is formed in a basal part of the contact portion, wherein the bulging portion bulges away from the guide surface and toward the insertion hole.

2. The manufacturing method according to claim 1, wherein the contraction pressing process is performed a plurality of times, and the guide surface has a radius that becomes smaller in a stepwise manner in die cavities used in latter contraction pressing processes.

3. The manufacturing method according to claim 1, wherein the first diameter is two times or greater than the second diameter.

4. The method according to claim 1, further comprising:

applying an apparatus to manufacture the contact terminal, the apparatus comprising:

the die plate including a plurality of die cavities arranged along a feeding direction of the metal plate that forms the contact terminal, wherein the die cavities are arranged from one having a larger diameter than the contact portion to one having the same diameter as the contact portion so that the diameter gradually decreases, and the die cavities have the same depth or a depth that gradually decreases in the feeding direction;

a plurality of the punches that can respectively be fitted into the die cavities to cooperate with the die cavities and perform the contraction pressing process on the metal plate arranged between the punches and the die cavities;

a one of the die cavities having the largest diameter is used to perform the drawing process that forms the contact portion in the metal plate, wherein the contact portion projects in the thicknesswise direction of the metal plate; and the contact portion is formed by performing the contraction pressing process that gradually decreases the diameter of the contact portion with the remaining die cavities from those having larger diameters.

5. The method according to claim 4, wherein the apparatus further comprises a stripper plate facing the die plate, the stripper plate holds the metal plate arranged on the die plate with the die plate to fit a distal part of the contact portion into the die cavity having a smaller diameter than the contact portion, and each of the die cavities includes an open end that defines a guide surface having an arcuate cross-section, and the guide surface has a radius that becomes smaller in a stepwise manner in the feeding direction.

6. The method according to claim 4, wherein the die cavities have the same depth.

7. The method according to claim 4, wherein each of the plurality of punches includes a distal part defining a punching portion, the punching portion cooperates with the corresponding die cavity to fit the contact portion into the die cavity and perform the contraction pressing process on the contact portion, and the punching portions of the punches have the same height and different diameters.

* * * * *